US011052696B2

(12) United States Patent
Okamoto et al.

(10) Patent No.: US 11,052,696 B2
(45) Date of Patent: Jul. 6, 2021

(54) SHEET BUNDLE DISCHARGING APPARATUS

(71) Applicant: CANON FINETECH NISCA INC., Misato (JP)

(72) Inventors: Koji Okamoto, Tsukubamirai (JP); Tadahito Takano, Fuefuki (JP); Tsukasa Kondou, Nishiyatsushiro-gun (JP)

(73) Assignee: Canon Finetech Nisca Inc., Saitama (JP)

( * ) Notice: Subject to any disclaimer, the term of this patent is extended or adjusted under 35 U.S.C. 154(b) by 34 days.

(21) Appl. No.: 16/707,231

(22) Filed: Dec. 9, 2019

(65) Prior Publication Data

US 2020/0189307 A1 Jun. 18, 2020

(30) Foreign Application Priority Data

Dec. 12, 2018 (JP) ..... JP2018-232583
Nov. 25, 2019 (JP) ..... JP2019-212368

(51) Int. Cl.

| | |
|---|---|
| ***B65H 37/04*** | (2006.01) |
| ***B65H 31/32*** | (2006.01) |
| ***B42C 19/02*** | (2006.01) |
| ***B42C 1/12*** | (2006.01) |
| *G03G 15/00* | (2006.01) |

(52) U.S. Cl.

CPC ..... *B42C 19/02* (2013.01); *B42C 1/12* (2013.01); *B65H 31/32* (2013.01); *B65H 37/04* (2013.01); *G03G 15/6538* (2013.01)

(58) Field of Classification Search

CPC ..... B65H 2801/48; B65H 31/32; B65H 2701/1829; B65G 45/24

See application file for complete search history.

(56) References Cited

U.S. PATENT DOCUMENTS

| | | | | |
|---|---|---|---|---|
| 6,339,685 | B1 | 1/2002 | Okamoto et al. | |
| 6,430,382 | B1 | 8/2002 | Okamoto et al. | |
| 7,156,391 | B2 | 1/2007 | Okamoto et al. | |
| 8,231,321 | B2 * | 7/2012 | Hasegawa ..... | B26D 7/015 412/38 |
| 9,890,010 | B2 | 2/2018 | Okamoto | |

(Continued)

FOREIGN PATENT DOCUMENTS

JP 2005-305822 A 11/2005

*Primary Examiner* — Jennifer Bahls
(74) *Attorney, Agent, or Firm* — Venable LLP

(57) ABSTRACT

A sheet bundle discharging apparatus, including: a guide unit configured to guide a sheet bundle with a spine as a leading end; a receiving unit configured to receive the spine of the sheet bundle guided by the guide unit; and a discharging unit configured to discharge the sheet bundle, wherein the receiving unit includes: a first surface configured to receive the spine at a first position; a second surface configured to push the sheet bundle in a rotation direction of the receiving unit; and a third surface configured to regulate a movement of the sheet bundle in the rotation direction while the receiving unit rotates from the first position to a second position, and wherein a friction coefficient between the sheet bundle and the third surface in a direction away from the first surface is larger than a friction coefficient between the first surface and the sheet bundle.

9 Claims, 14 Drawing Sheets

(56) References Cited

U.S. PATENT DOCUMENTS

| | | | | |
|---|---|---|---|---|
| 2011/0054672 | A1* | 3/2011 | McFarland | B42C 19/08 700/225 |
| 2013/0213766 | A1* | 8/2013 | Tas | B65H 31/3045 198/408 |
| 2014/0360839 | A1* | 12/2014 | Moesli | B65G 47/38 198/370.07 |
| 2020/0070561 | A1 | 3/2020 | Okamoto et al. | |

* cited by examiner

SHEET BUNDLE DISCHARGING APPARATUS

BACKGROUND OF THE INVENTION

Field of the Invention

The present invention relates to a sheet bundle discharging apparatus configured to discharge a sheet bundle.

Description of the Related Art

In Japanese Patent Application Laid-Open No. 2005-305822, there is disclosed a bookbinding apparatus including an accommodating section configured to accommodate a plurality of sheet bundles (booklets) which are each formed by binding a plurality of sheets each having an image formed thereon.

However, in the accommodating section disclosed in Japanese Patent Application Laid-Open No. 2005-305822, a user needs to take out the sheet bundles every time an accommodation amount of the sheet bundles reaches a certain amount. It is required that an operation of the bookbinding apparatus be stopped while the user takes out the sheet bundles from the accommodating section. Accordingly, a continuous bookbinding operation cannot be performed, and productivity of the apparatus cannot be improved. Moreover, in a case of performing the continuous bookbinding operation to improve the productivity of the apparatus, it is required to enable stable discharge of the sheet bundles in order to prevent stop of such continuous production of the sheet bundles due to occurrence of an abnormality.

SUMMARY OF THE INVENTION

According to at least one embodiment of the present invention, there is provided a sheet bundle discharging apparatus configured to discharge a sheet bundle including a spine, the sheet bundle discharging apparatus including: a conveyance unit configured to convey the sheet bundle; a guide unit configured to guide the sheet bundle conveyed by the conveyance unit so that the spine is located at a leading end; a receiving unit configured to receive the spine of the sheet bundle guided by the guide unit; and a discharging unit configured to discharge the sheet bundle to an outside of the sheet bundle discharging apparatus, wherein the receiving unit is rotatable between a first position and a second position, wherein the receiving unit receives the spine at the first position, wherein the receiving unit rotates from the first position to the second position to place the sheet bundle on the discharging unit, wherein the receiving unit includes: a first surface against which the spine abuts when the receiving unit receives the spine at the first position; a second surface on which the sheet bundle is slidable before the spine abuts against the first surface, the second surface being configured to push the sheet bundle in a rotation direction of the receiving unit while the receiving unit rotates from the first position to the second position; and a third surface which is arranged so as to be opposed to the second surface, the third surface being configured to regulate a movement of the sheet bundle in the rotation direction of the receiving unit while the receiving unit rotates from the first position to the second position, and wherein, on the third surface, a friction coefficient between the sheet bundle and the third surface in a direction away from the first surface is larger than a friction coefficient between the first surface and the sheet bundle.

The sheet bundle discharging apparatus according to at least one embodiment of the present invention can stably discharge the sheet bundle.

Further features of the present invention will become apparent from the following description of exemplary embodiments with reference to the attached drawings.

DESCRIPTION OF THE EMBODIMENTS

Now, with reference to the drawings, description is made of an image forming system which includes a bookbinding apparatus including a sheet bundle discharging apparatus according to an embodiment of the present invention.

Figure 1:
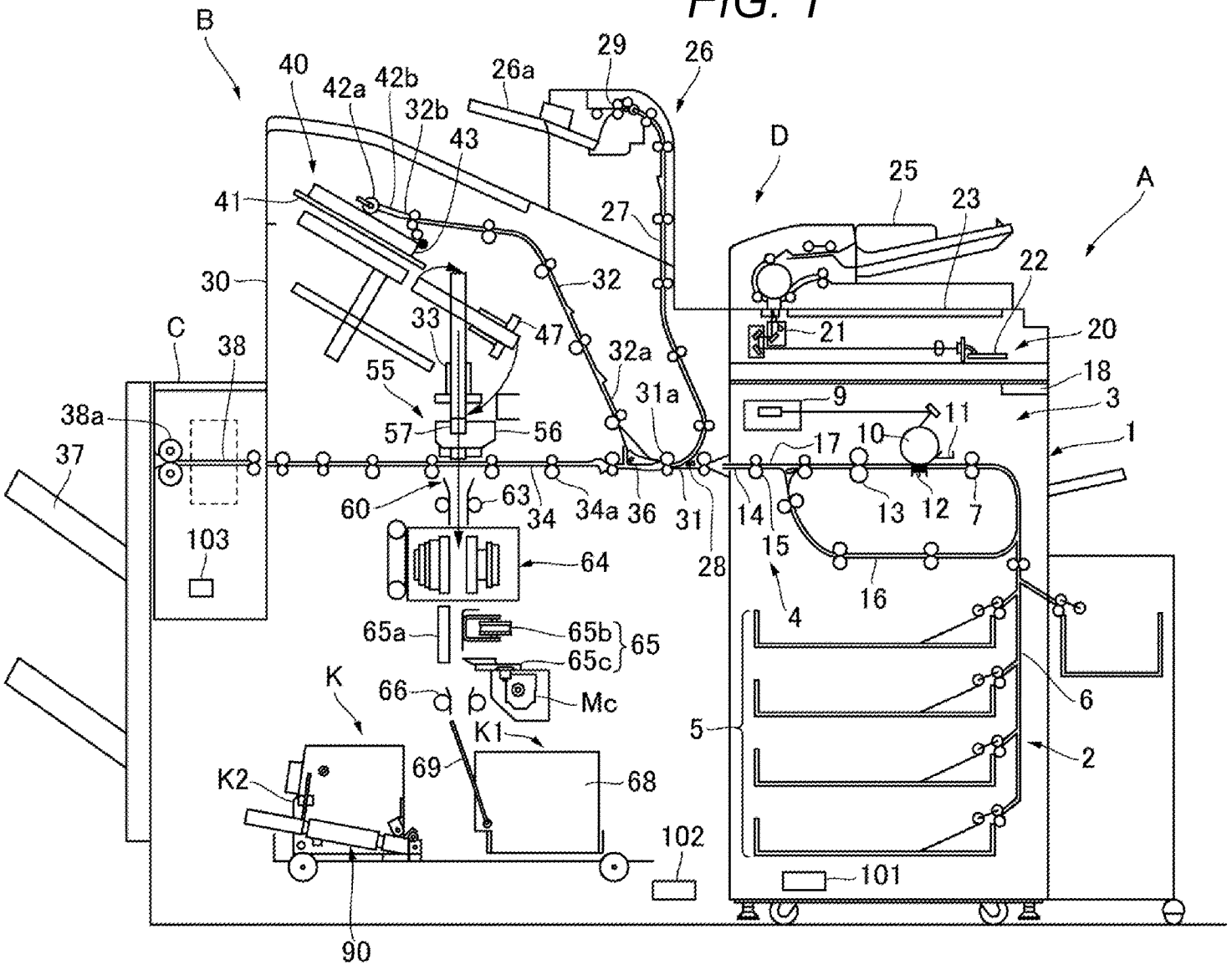
FIG. 1 is a schematic view for illustrating an image forming apparatus according to an embodiment of the present invention.
Figure 2:
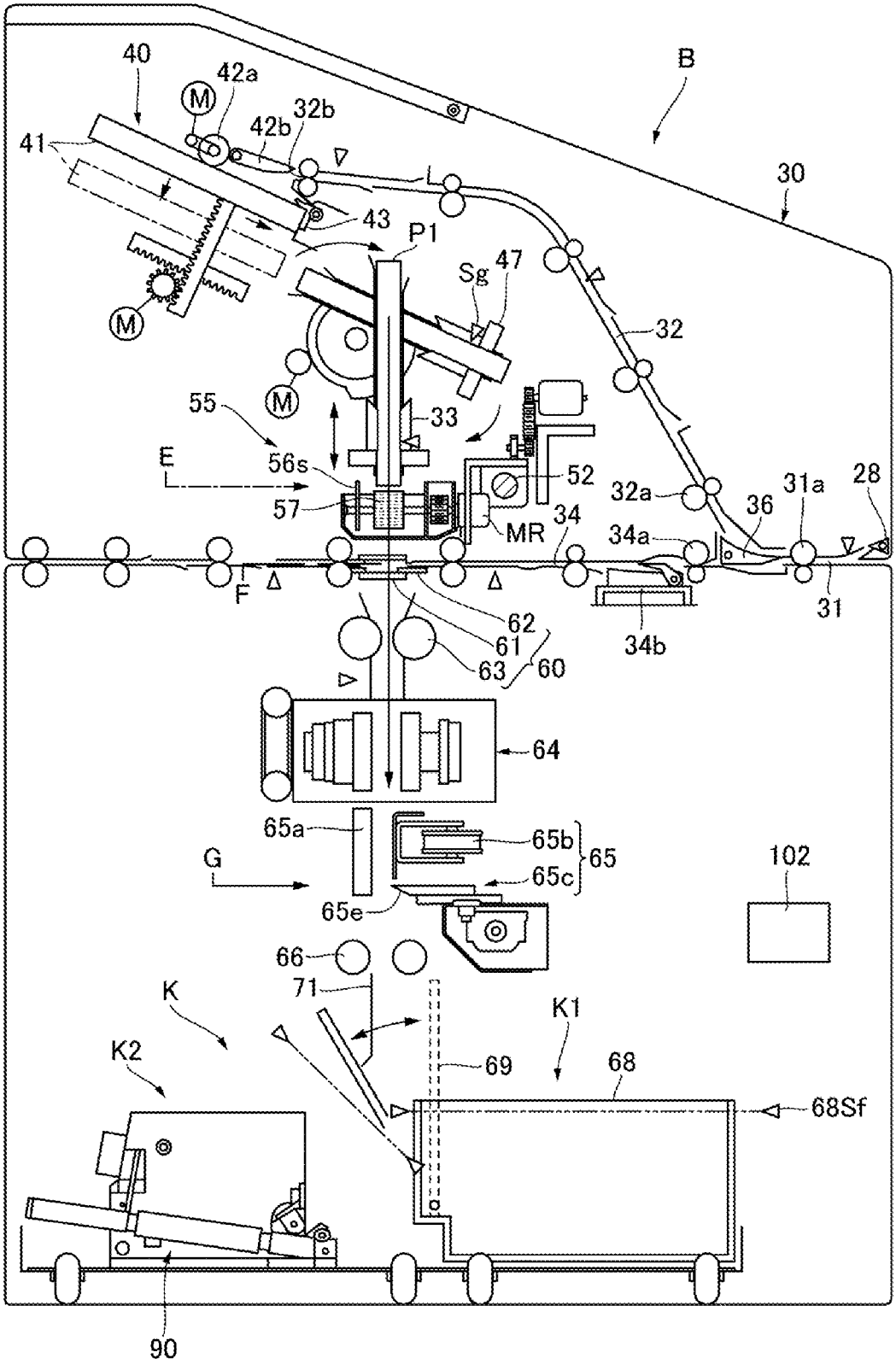
FIG. 2 is a schematic sectional view for illustrating a bookbinding apparatus according to the embodiment of the present invention.

FIG. 1 is a schematic sectional view for illustrating an image forming system D taken along a sheet conveyance direction. FIG. 2 is a schematic sectional view for illustrating a bookbinding apparatus B taken along the sheet conveyance direction.

The image forming system D includes an image forming apparatus A, the bookbinding apparatus B, and a post-processing apparatus C. The image forming apparatus A is configured to sequentially form toner images on sheets. The bookbinding apparatus B is arranged on a downstream side of the image forming apparatus A. The post-processing apparatus C is arranged on downstream of the bookbinding apparatus B. The image forming system D uses the bookbinding apparatus B to perform bookbinding processing on the sheets having been subjected to image formation in the image forming apparatus A. Further, the image forming system D allows sheets which are not subjected to the bookbinding processing to pass through the bookbinding apparatus B, uses the post-processing apparatus C to perform post-processing on the sheets, and discharges the sheets.

[Image Forming Apparatus A]

The image forming apparatus A is configured to form images on sheets. A variety of apparatuses such as a copying machine, a printer, and a printing machine are adoptable as the image forming apparatus A. In this embodiment, the image forming apparatus A as a copying machine configured to form toner images on sheets is adopted. The image forming apparatus A includes, in an apparatus main body 1 thereof, a sheet supply portion 2, an image forming portion 3, a sheet discharging portion 4, and an image forming apparatus controller 101. In the sheet supply portion 2, a plurality of cassettes 5 corresponding to respective sheet sizes are arrayed in an up-and-down direction. The sheet supply portion 2 sends out a sheet having a size designated by the image forming apparatus controller 101 to a feed passage 6. In the feed passage 6, a registration roller pair 7 is provided. The registration roller pair 7 aligns a leading end of the sheet, and feeds the sheet having the leading end aligned to the image forming portion 3 on the downstream side at a predetermined timing.

The image forming portion 3 includes an electrostatic drum 10. In a periphery of the electrostatic drum 10, there are provided, for example, a print head 9, a developing device 11, and a transfer charger 12. The print head 9 is formed of, for example, a laser emitter, and is configured to form an electrostatic latent image on the electrostatic drum 10. The electrostatic latent image is developed with toner by the developing device 11 to be formed into a toner image. The toner image is transferred onto a sheet by the transfer charger 12. The toner image having been transferred onto the sheet is fixed on the sheet by a fixing device 13. After that, the sheet is delivered to a sheet discharging passage 17. In the sheet discharging portion 4, a sheet discharge port 14 is formed, and in addition, a sheet discharging roller pair 15 is arranged. A circulation passage 16 is used in a case of forming an image on both surfaces of a sheet. In the circulation passage 16, the sheet delivered from the sheet discharging passage 17 is delivered to a switchback passage and reversed front and back therein, and the sheet is thereafter guided to the registration roller pair 7 again. A toner image is formed on a back surface of the sheet by the image forming portion 3. In such a manner, the sheet having the toner image formed on one side or both sides is fed from the sheet discharge port 14 to the bookbinding apparatus B by the sheet discharging roller pair 15.

A scanner unit 20 provided on top of the apparatus main body 1 is configured to optically read an image of an original. The scanner unit 20 includes, for example, a platen glass 23, a carriage 21, and an optical reading unit 22. The platen glass 23 is configured to receive an original to be placed thereon by a user. The carriage 21 is configured to optically read an original along the platen glass 23. The optical reading unit 22 is configured to perform photoelectric conversion on an optical image transmitted from the carriage 21. For example, a CCD device is used for the optical reading unit 22. The scanner unit 20 includes, on top thereof, an original feeder 25 configured to automatically feed an original to the platen glass 23.

[Bookbinding Apparatus B]

FIG. 2 is a schematic sectional view for illustrating the bookbinding apparatus B taken along the sheet conveyance direction. The bookbinding apparatus B is connected to the image forming apparatus A. In the following description, a sheet which serves as a cover of a sheet bundle is referred to as "cover". A sheet covered with the cover is referred to as "inner sheet". A bundle of inner sheets is referred to as "inner sheet bundle". Moreover, in the following description, the inner sheet bundle covered with the cover is referred to also as "sheet bundle covered with the cover". A sheet bundle covered with the cover which has been trimmed is referred to also as "booklet". Those sheet bundles are simply referred to also as "sheet bundle".

The bookbinding apparatus B includes a casing 30, a stacking portion 40, and an adhesive applying portion 55. The stacking portion 40 is provided in the casing 30, and is configured to stack inner sheets having toner images formed thereon into a bundle and to align the bundle. The adhesive applying portion 55 is configured to apply an adhesive to the inner sheet bundle delivered from the stacking portion 40. Moreover, the bookbinding apparatus B includes a cover binding portion 60, a bundle attitude deviating portion 64, and a cutting portion 65. The cover binding portion 60 is configured to bind a cover on the inner sheet bundle having the adhesive applied thereto. The bundle attitude deviating portion 64 is configured to change an orientation of the sheet bundle covered with the cover, on which the cover is bound. The cutting portion 65 is configured to perform trim-cutting on an edge of the sheet bundle changed in orientation. Furthermore, the bookbinding apparatus B includes a sheet bundle discharging apparatus K configured to discharge the booklet formed through the trim-cutting.

[Configuration of Conveyance Passage]

Description is made of each conveyance passage for the sheets. In the casing 30, there is provided a carry-in passage 31 which continues from the sheet discharge port 14 of the image forming apparatus A. The carry-in passage 31 is connected to an inner sheet conveyance passage 32 and a cover conveyance passage 34 through intermediation of a passage switching member 36. The inner sheet conveyance passage 32 is connected to a bookbinding passage 33 through intermediation of the stacking portion 40. The cover conveyance passage 34 is connected to a post-processing passage 38 of the post-processing apparatus C (see FIG. 1) described later. The bookbinding passage 33 extends vertically through the bookbinding apparatus B in a substantially vertical direction. The cover conveyance passage 34 extends horizontally through the bookbinding apparatus B in a substantially horizontal direction. Therefore, the bookbinding passage 33 and the cover conveyance passage 34 intersect (cross) each other. In the bookbinding apparatus B, the cover binding portion 60 described later is arranged at a part at which the bookbinding passage 33 and the cover conveyance passage 34 intersect each other.

With the configuration of the conveyance passages as described above, the carry-in passage 31 receives, from the image forming apparatus A, sheets (inner sheets) having toner images formed thereon. In this case, the inner sheets and a print sheet (cover), which is to be used as a cover and has a title and the like printed thereon, are fed from the image forming apparatus A. The inner sheets and the cover are selectively delivered to the inner sheet conveyance passage 32 and the cover conveyance passage 34 by the passage switching member 36.

Moreover, an inserter apparatus 26 is connected to the carry-in passage 31 (see FIG. 1). The inserter apparatus 26 is configured to feed covers, which are not subjected to printing in the image forming apparatus A, one after another from a feed tray 26*a* to the carry-in passage 31. The inserter apparatus 26 includes, for example, one or a plurality of feed tray 26*a*, a cover feeding portion 29, and a cover feeding passage 27. The cover feeding portion 29 is arranged at a distal end of the feed tray 26*a*, and is configured to separate and feed one after another sheets stacked on the feed tray 26*a*. The cover feeding passage 27 is provided on a downstream side of the cover feeding portion 29. The cover feeding passage 27 is connected to the carry-in passage 31 through intermediation of a passage switching member 28. A conveyance roller pair 31*a* is arranged on the carry-in passage 31. A conveyance roller pair 32*a* is arranged on the inner sheet conveyance passage 32. On the bookbinding passage 33, there are provided, for example, a grip conveyance portion 47, the bundle attitude deviating portion 64 described later, and a sheet bundle discharging roller pair 66. A conveyance roller pair 34*a* is arranged on the cover conveyance passage 34. A conveyance roller pair 38*a* is arranged on the post-processing passage 38 of the post-processing apparatus C described later. The inner sheets and the cover are fed by respective conveying roller pairs to be rotated by respective drive motors (not shown).

[Post-Processing Apparatus C]

As illustrated in FIG. 1, the post-processing apparatus C is connected to the bookbinding apparatus B. The post-processing apparatus C includes the post-processing passage 38 continuing from the cover conveyance passage 34. In the post-processing passage 38, at least one post-processing device such as a stapling unit, a punching unit, or a stamping unit is arranged. The post-processing passage 38 receives, through the cover conveyance passage 34, sheets having been subjected to image formation and delivered from the image forming apparatus A. The post-processing apparatus C performs at least one post-processing such as stapling, punching, or stamping on the sheets having been subjected to image formation and received from the image forming apparatus. Then, the post-processing apparatus C conveys the sheets having been subjected to image formation to a discharge tray 37. Moreover, the post-processing apparatus C is configured so as to enable discharge of the sheets having been subjected to image formation to the discharge tray 37 without performing the post-processing.

[Stacking Portion 40]

A stack tray 41 arranged at an inner sheet discharging port 32*b* of the inner sheet conveyance passage 32 is configured to stack and accommodate the inner sheets, which have been discharged from the inner sheet discharging port 32*b*, in a bundle shape. As illustrated in FIG. 2, the stack tray 41 is formed of a tray member arranged in a substantially horizontal attitude, and there are arranged a forward/reverse rotation roller 42*a* and a carry-in guide 42*b* above the stack tray 41. The inner sheets having been discharged from the inner sheet discharging port 32*b* are guided to a position above the stack tray 41 by the carry-in guide 42*b*, and are accommodated on the stack tray 41 by the forward/reverse rotation roller 42*a*. The forward/reverse rotation roller 42*a* performs forward rotation to deliver the inner sheets toward a distal end side of the stack tray 41, and performs reverse rotation to bring a trailing edge of the inner sheets into abutment against a regulation member 43 arranged at a tray rear end (right end in FIG. 2), to thereby regulate the inner sheets. A pair of sheet side alignment plates (not shown) are provided to the stack tray 41, and the sheet side alignment plates align both side edges of the inner sheets accommodated on the stack tray 41. With such a configuration, the inner sheets having been delivered from the inner sheet conveyance passage 32 are sequentially stacked on the stack tray 41, and then are aligned into a bundle shape.

[Grip Conveyance Portion 47]

The grip conveyance portion 47 is provided on the bookbinding passage 33. The grip conveyance portion 47 is configured to deliver the sheets from the stack tray 41 to an adhesive applying position E on the downstream side. The stack tray 41 passes the inner sheet bundle to the grip conveyance portion 47 which waits at a substantially horizontal passing position. As illustrated in FIG. 2, the grip conveyance portion 47 changes an attitude of the inner sheet bundle stacked on the stack tray 41 from a substantially horizontal attitude to a vertical attitude. Then, the grip conveyance portion 47 sets the inner sheet bundle at the adhesive applying position E so that the inner sheet bundle is placed along the bookbinding passage 33 arranged so as to extend in a substantially vertical direction.

[Adhesive Applying Portion 55]

Figure 3A:
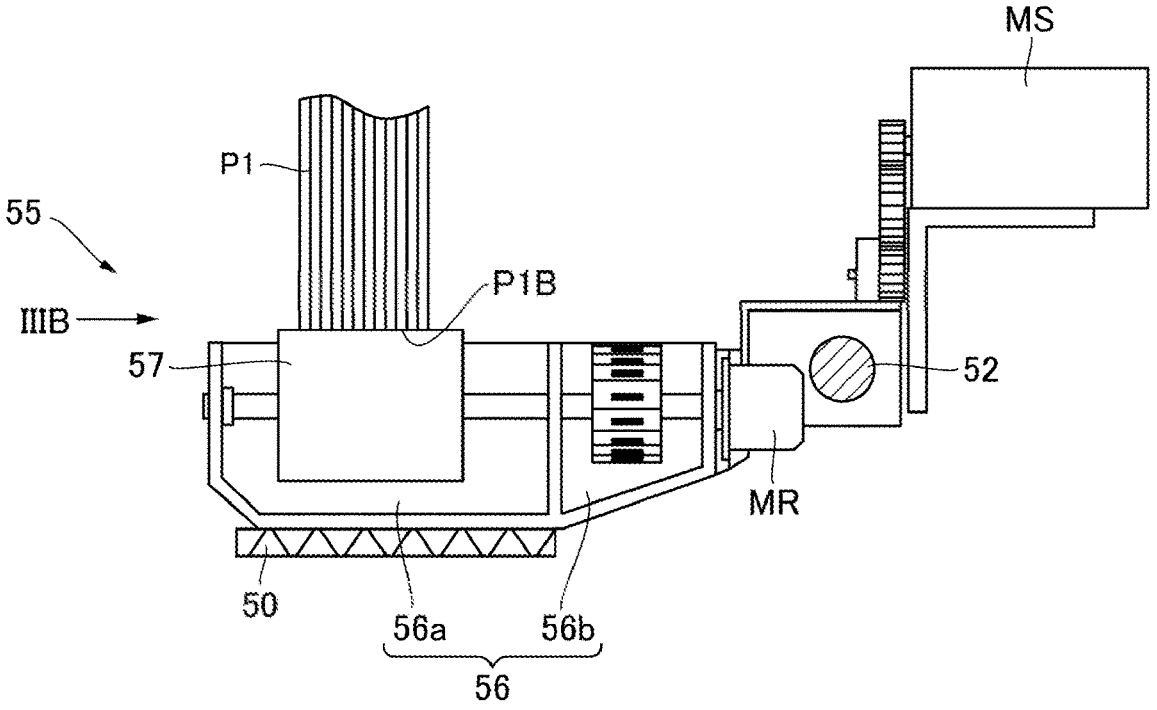
FIG. 3A is a front view for illustrating an adhesive applying portion according to the embodiment of the present invention.
Figure 3B:
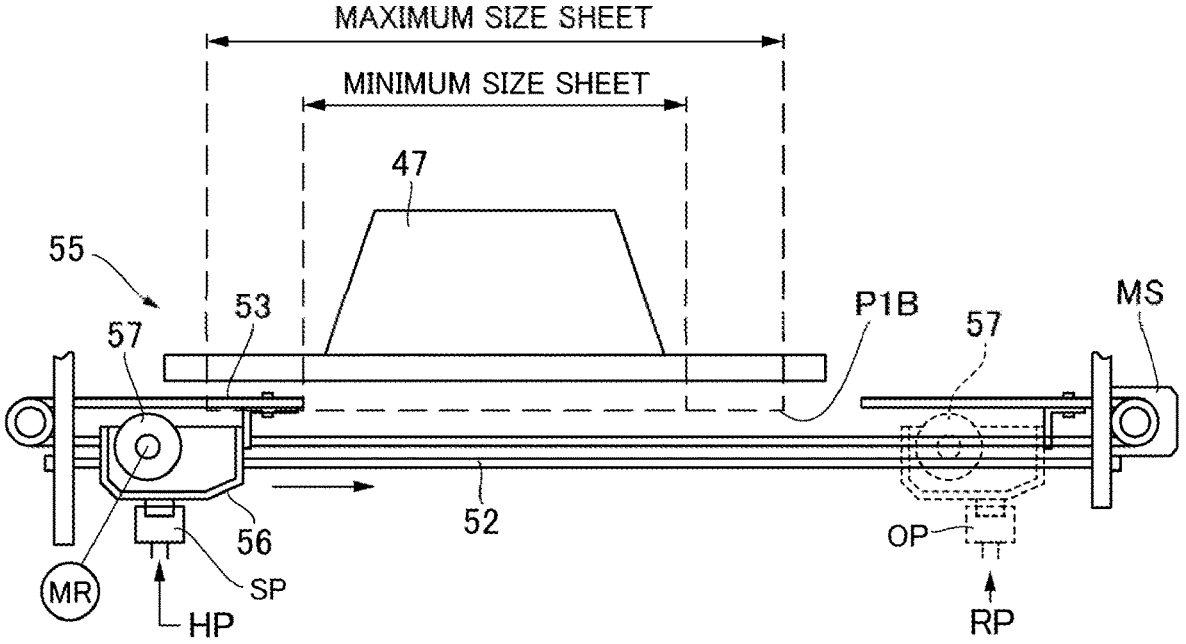
FIG. 3B is a view as seen in a direction indicated by an arrow IIIB of FIG. 3A.

FIG. 3A and FIG. 3B are views of the adhesive applying portion 55. FIG. 3A is a front view. FIG. 3B is a view as seen in a direction indicated by an arrow IIIB of FIG. 3A. In FIG. 2, FIG. 3A, and FIG. 3B, the adhesive applying portion 55 is arranged at the adhesive applying position E of the bookbinding passage 33. The adhesive applying portion 55 includes an adhesive container 56, an applying roll 57, and a roll rotation motor MR. The adhesive container 56 is configured to accommodate a thermally meltable adhesive. The adhesive container 56 is divided into a liquid adhesive accommodating chamber 56*a* and a solid adhesive accommodating chamber 56*b*. The applying roll 57 is rotatably incorporated into the liquid adhesive accommodating chamber 56*a*. An adhesive sensor 56*s* (see FIG. 2) configured to detect a remaining amount of the adhesive is provided in the liquid adhesive accommodating chamber 56*a*. The adhesive sensor 56*s* serves also as a temperature sensor configured to detect a temperature of the adhesive. That is, the adhesive sensor 56*s* is configured to detect a temperature of the liquefied adhesive in the liquid adhesive accommodating chamber 56*a*, and at the same time, detect a remaining amount of the adhesive based on a temperature difference at a part soaked in the adhesive. Further, a heating element 50 such as an electrothermal heater is provided to the adhesive container 56. The adhesive sensor 56*s* and the heating element 50 are connected to a bookbinding apparatus controller 102 (FIG. 1 and FIG. 2). The bookbinding apparatus controller 102 is configured to adjust a temperature of the adhesive in the liquid adhesive accommodating chamber 56*a* to a predetermined melting temperature based on a detected temperature of the adhesive sensor 56*s*. The applying roll 57 is formed of a heat-resistant porous material, and is configured to allow the adhesive to be impregnated thereinto to thereby allow a layer of the adhesive to bulge on a periphery of the roll.

The adhesive container 56 having the configuration as described above is driven to reciprocate along a back side of the inner sheet bundle. As illustrated in FIG. 3B, the adhesive container 56 is formed so as to have a length (dimension) shorter than a lower end edge (back cover portion at the time of bookbinding) P1B of the inner sheet bundle. The adhesive container 56 is supported on a guide rail 52 of the casing 30 so as to be movable along the lower end edge P1B of an inner sheet bundle P1 together with the applying roll 57 provided inside the adhesive container 56. The adhesive container 56 is coupled to a timing belt 53. An adhesive container moving motor MS is coupled to the timing belt 53.

The adhesive container 56 is guided by the guide rail 52 between a home position HP on the left side in FIG. 3B and a return position RP on the right side in FIG. 3B at which the returning operation along the sheet bundle is started, and is reciprocated by the adhesive container moving motor MS. The return position RP is set based on size information of a sheet width. The home position HP of the adhesive container 56 is detected by the home position sensor SP. The adhesive container 56 waits at the home position HP when an apparatus power supply is turned on (in an initial state). The adhesive container 56 is moved from the home position HP to the return position RP after elapse of a predetermined time (estimated time for the sheet bundle to arrive at the adhesive applying position E) from output of a sheet grip signal of a grip sensor Sg (see FIG. 2) provided to, for example, the preceding grip conveyance portion 47. A position of the adhesive container 56 can be detected by counting drive pulses of the adhesive container moving motor MS. An overrun sensor OP may be provided to the return position RP as illustrated in FIG. 3B, and overrun of the position of the adhesive container 56 may be prevented based on a detection result of the overrun sensor OP.

Simultaneously with the movement of the adhesive container 56 from the home position HP to the return position RP, the applying roll 57 starts rotation by the roll rotation motor MR. The adhesive applying portion 55 having such a configuration starts movement from the left side toward the right side in FIG. 3B through the rotation of the adhesive container moving motor MS and the guidance with the guide rail 52. On a forward passage from the left side toward the right side in FIG. 3B, the applying roll 57 is held in pressure contact with the sheet bundle to loosen the end portion of the sheet bundle. An elevation motor (not shown) is used to adjust a delivery amount of the above-mentioned grip conveyance portion 47 so that the applying roll 57 applies the adhesive to the sheet bundle while defining a predetermined gap with the end portion of the sheet bundle on a return path for returning from the return position RP to the home position HP.

[Cover Binding Portion 60]

Figure 4:
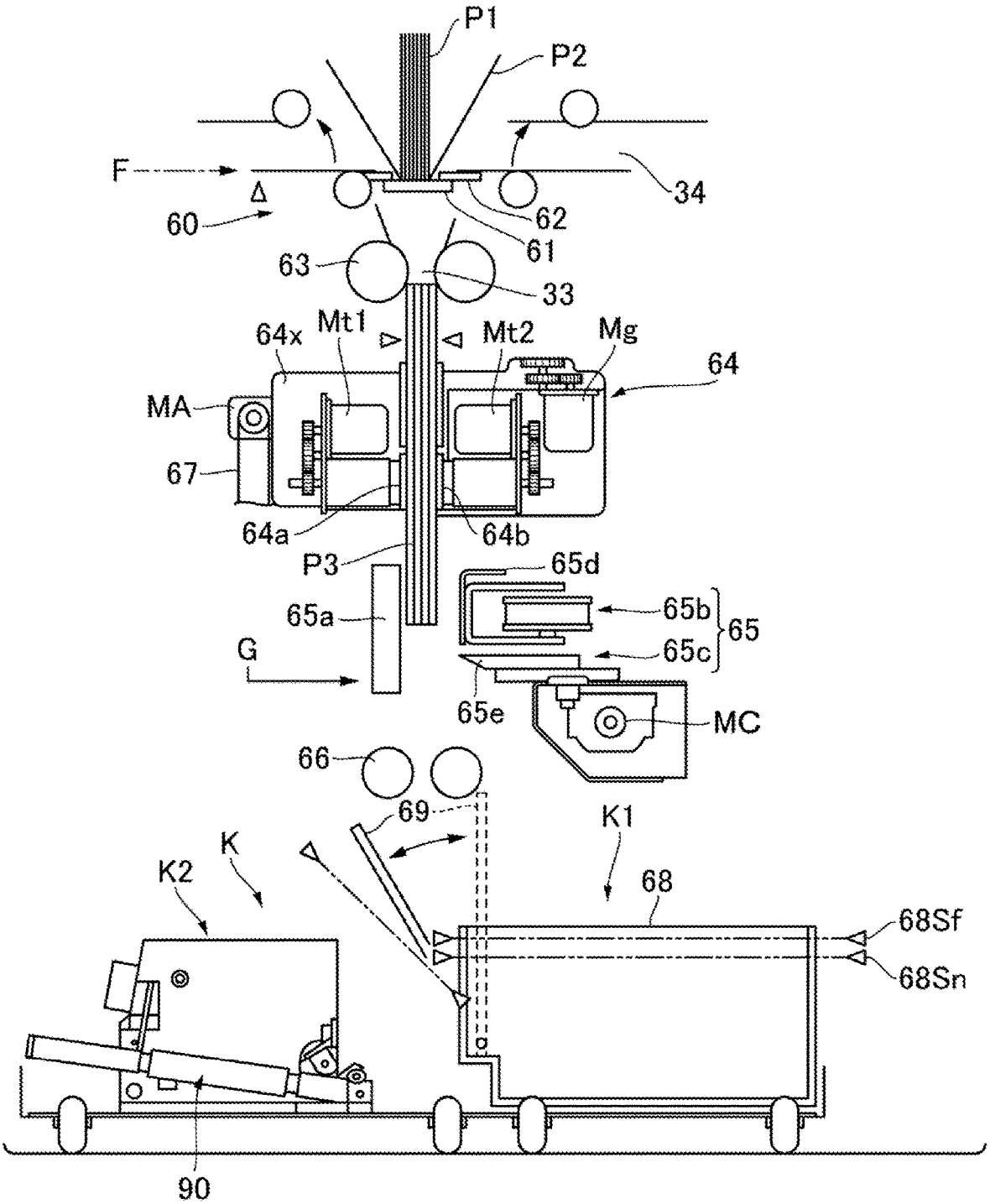
FIG. 4 is a schematic view for illustrating a cover binding portion, a bundle attitude deviating portion, a cutting portion, and a discharging portion according to the embodiment of the present invention.

FIG. 4 is a view for illustrating the cover binding portion 60, the bundle attitude deviating portion 64, the cutting portion 65, and the sheet bundle discharging apparatus K. The cover binding portion 60 as a binding unit is provided at a cover binding position F on the bookbinding passage 33. The cover binding portion 60 is formed of, for example, a spine abutment plate 61, spine folding plates 62, and a folding roller pair 63. The cover conveyance passage 34 is arranged at the cover binding position F, and the cover is fed from the image forming apparatus A or the inserter apparatus 26. The spine abutment plate 61 is formed of a plate-shaped member configured to back up the cover, and is arranged on the bookbinding passage 33 so as to be able to freely advance and retreat. An inner sheet bundle P1 to be covered with a cover P2 supported by the spine abutment plate 61 is joined to the cover P2 in a reversed T shape. The spine folding plates 62 are formed of a pair of right and left press members. In order to fold a spine of the cover joined in the reversed T shape, the spine folding plates 62 approach and separate from each other by a driving portion (not shown). The spine folding plates 62 approach each other to fold the spine of the cover P2. The folding roller pair 63 sandwiches and pressurizes a sheet bundle P3 covered with the cover, the sheet bundle P3 being formed in such a manner that the spine of the cover P2 is folded, thereby finishing the covering.

[Bundle Attitude Deviating Portion 64 and Cutting Portion 65]

As illustrated in FIG. 4, on a downstream side of the folding roller pair 63, there is arranged the bundle attitude deviating portion 64 configured to deviate a vertical direction of the sheet bundle covered with the cover. At a cutting position G located on the downstream side of the bundle attitude deviating portion 64, there is provided the cutting portion 65 configured to cut a peripheral edge of the sheet bundle P3 covered with the cover. The bundle attitude deviating portion 64 is configured to allow the sheet bundle P3 covered with the cover to be deviated in a predetermined direction (attitude) from the adhesive applying position E (see FIG. 2) and feed the sheet bundle P3 to the cutting portion 65 or the sheet bundle discharging apparatus K on the downstream side. The cutting portion 65 is configured to trim the peripheral edge being a portion to be cut of the sheet bundle covered with the cover. Therefore, the bundle attitude deviating portion 64 includes rotation tables 64*a* and 64*b* configured to grip and rotate the sheet bundle P3 covered with the cover having been delivered from the folding roller pair 63. The rotation tables 64*a* and 64*b* are provided on a unit frame 64*x* mounted to the casing 30 (see FIG. 2) so as to be able to be freely elevated. On the unit frame 64*x*, the pair of rotation tables 64*a* and 64*b* are arranged across the bookbinding passage 33 and are axially supported so as to be freely rotatable. One rotation table 64*b* is supported on the unit frame 64*x* so as to freely move in a thickness direction (direction orthogonal to the bookbinding passage 33) of the sheet bundle P3 covered with the cover. Rotation motors Mt1 and Mt2 configured to deviate an attitude of the sheet bundle P3 covered with the cover in the bookbinding passage 33 are provided for the rotation tables 64*a* and 64*b*, respectively. Further, a grip motor Mg configured to move in a right-and-left direction in FIG. 4 is mounted to the rotation table 64*b* on a movable side. The unit frame 64*x* allows, through use of an elevation motor MA, the sheet bundle P3 covered with the cover to be elevated along the bookbinding passage 33. The elevation motor MA is fixed to a fixing member (not shown). The elevation motor MA is configured to circulate a belt 67 coupled to the unit frame 64*x*, to thereby elevate the unit frame 64*x*.

The sheet bundle P3 covered with the cover having been guided into the bookbinding passage 33 is gripped by the pair or left and right rotation tables 64*a* and 64*b* and is subjected to deviation of an attitude direction by the rotation motors Mt1 and Mt2. The rotation tables 64*a* and 64*b* are capable of rotating the sheet bundle P3 covered with the cover, which has been conveyed with the spine arranged on a lower side, by 180 degrees and delivering the sheet bundle P3 covered with the cover with a fore edge portion thereof to the lower side to the sheet bundle discharging roller pair 66 on the downstream side. Moreover, the rotation tables 64*a* and 64*b* are also capable of enabling the trim-cutting. In the trim-cutting, the rotation tables 64*a* and 64*b* rotate the sheet bundle P3 covered with the cover sequentially by 90 degrees, and deviate a top portion, base portion, and fore edge portion of the sheet bundle P3 covered with the cover individually to the lower side toward the cutting position G, thereby a peripheral edge of three sides of the sheet bundle P3 covered with the cover is cut. A grip sensor (not shown) is provided to the rotation table 64*b* on the movable side. The rotation tables 64*a* and 64*b* are driven to rotate after the grip sensor (not shown) detects that the sheet bundle P3 covered with the cover is reliably gripped between the left and right rotation tables 64*a* and 64*b*.

[Cutting Portion 65]

As illustrated in FIG. 4, the cutting portion 65 is arranged on the downstream side of the bundle attitude deviating portion 64. The cutting portion 65 includes, for example, a blade receiving member 65*a*, a cut edge pressing unit 65*b*, and a cutting blade unit 65*c*. The cut edge pressing unit 65*b* is configured to press and hold a cut edge of a sheet bundle covered with the cover against the blade receiving member 65*a*. The cutting blade unit 65*c* is configured to cut the cut edge. The cut edge pressing unit 65*b* is arranged at a position opposed to the blade receiving member 65*a* arranged on the bookbinding passage 33. The cut edge pressing unit 65*b* includes, for example, a pressurizing member 65*d* configured to be driven by a driving portion (not shown) to move in a direction perpendicular to the sheet bundle P3 covered with the cover. The cutting blade unit 65*c* includes a cutting blade 65*e* and a cutter motor MC. The cutting blade 65*e* has a flat blade shape. The cutter motor MC is configured to drive the cutting blade 65*e*. The cutting portion 65 having such a configuration is configured to perform trim-cutting, which is an operation of cutting and trimming a predetermined amount of a peripheral edge (cut edge) excluding the spine of the sheet bundle P3 covered with the cover.

[Sheet Bundle Discharging Apparatus K]

As illustrated in FIG. 4, the sheet bundle discharging apparatus K is arranged below the cutting position G, and includes, for example, a cutting scrap collecting portion K1 and a sheet bundle discharging portion K2.

[Cutting Scrap Collecting Portion K1]

As illustrated in FIG. 4, the cutting scrap collecting portion K1 includes, for example, a sweeper portion 69, a cutting scrap collecting container 68, a full sensor 68Sf, and a near full sensor 68Sn, and is configured to accommodate a cutting scrap cut by the cutting blade 65*e*.

The sweeper portion 69 is provided immediately below the cutting position G. The sweeper portion 69 is driven by a driving motor (not shown) to rotate between a position indicated by the solid lines and a position indicated by the broken lines in FIG. 4. When the cutting portion 65 cuts the cut edge of the sheet bundle covered with the cover, the sweeper portion 69 waits in an inclined state at the position indicated by the solid lines for receiving the cutting scrap formed by the cutting. As illustrated in FIG. 2, the sweeper portion 69 and a discharging guide 71 described later are each formed into a comb-teeth shape so as not to interfere with each other when the sweeper portion 69 rotates.

The sweeper portion 69 waiting at the position indicated by the solid lines receives the cutting scrap, which is formed in the cutting portion 65 and falls through the sheet bundle discharging roller pair 66, and guides the cutting scrap into the cutting scrap collecting container 68 through use of the inclination. On this occasion, the sheet bundle P3 covered with the cover is held by the rotation tables 64*a* and 64*b* and hence do not fall. When the cutting processing by the cutting portion 65 on the sheet bundle covered with the cover is terminated, the sweeper portion 69 rotates to the position indicated by the broken lines, which is a position avoiding the location directly below the sheet bundle discharging roller pair 66 and is close to the cutting scrap collecting container 68. As a result, the sweeper portion 69 does not interfere with the falling booklet, which is released from being held by the rotation tables 64*a* and 64*b* and is discharged from the sheet bundle discharging roller pair 66. A booklet P4 (see FIG. 5) in which a peripheral edge other than a spine is cut in the cutting portion 65 falls to the sheet bundle discharging portion K2.

When a certain amount of the cutting scrap is collected into the cutting scrap collecting container 68, the near full sensor 68Sn detects that the cutting scrap collecting container 68 is nearly full. When the near full sensor 68Sn operates to detect that the cutting scrap collecting container 68 is nearly full, the bookbinding apparatus controller 102 (see FIG. 14) notifies the image forming apparatus controller 101 (see FIG. 14) that the cutting scrap collecting container 68 is nearly full. On an operation panel 18 (see FIG. 1 and FIG. 14) of the image forming apparatus A, the image forming apparatus controller 101 displays that the cutting scrap nearly fills the cutting scrap collecting container 68. In order to prevent the cutting scrap collecting container 68 from being full during the cutting of the sheet bundle covered with the cover, the near full sensor 68Sn is arranged so as to detect that the cutting scrap collecting container 68 is nearly full, for example, in a state in which the cutting scrap collecting container 68 is capable of accommodating cutting scrap equivalent to a single operation to cut the peripheral edge of the sheet bundle covered with the over. A full sensor 68Sf detects that the cutting scrap collecting container 68 becomes full of the cutting scrap. When the full sensor 68Sf detects that the cutting scrap collecting container 68 is full, the bookbinding apparatus controller 102 notifies the image forming apparatus controller 101 that the cutting scrap collecting container 68 is full. On the operation panel 18, the image forming apparatus controller 101 also makes a display to prompt the cutting scrap to be discarded as well as makes a display telling that the cutting scrap collecting container 68 is full of the cutting scrap.

[Sheet Bundle Discharging Portion K2]

Figure 5:
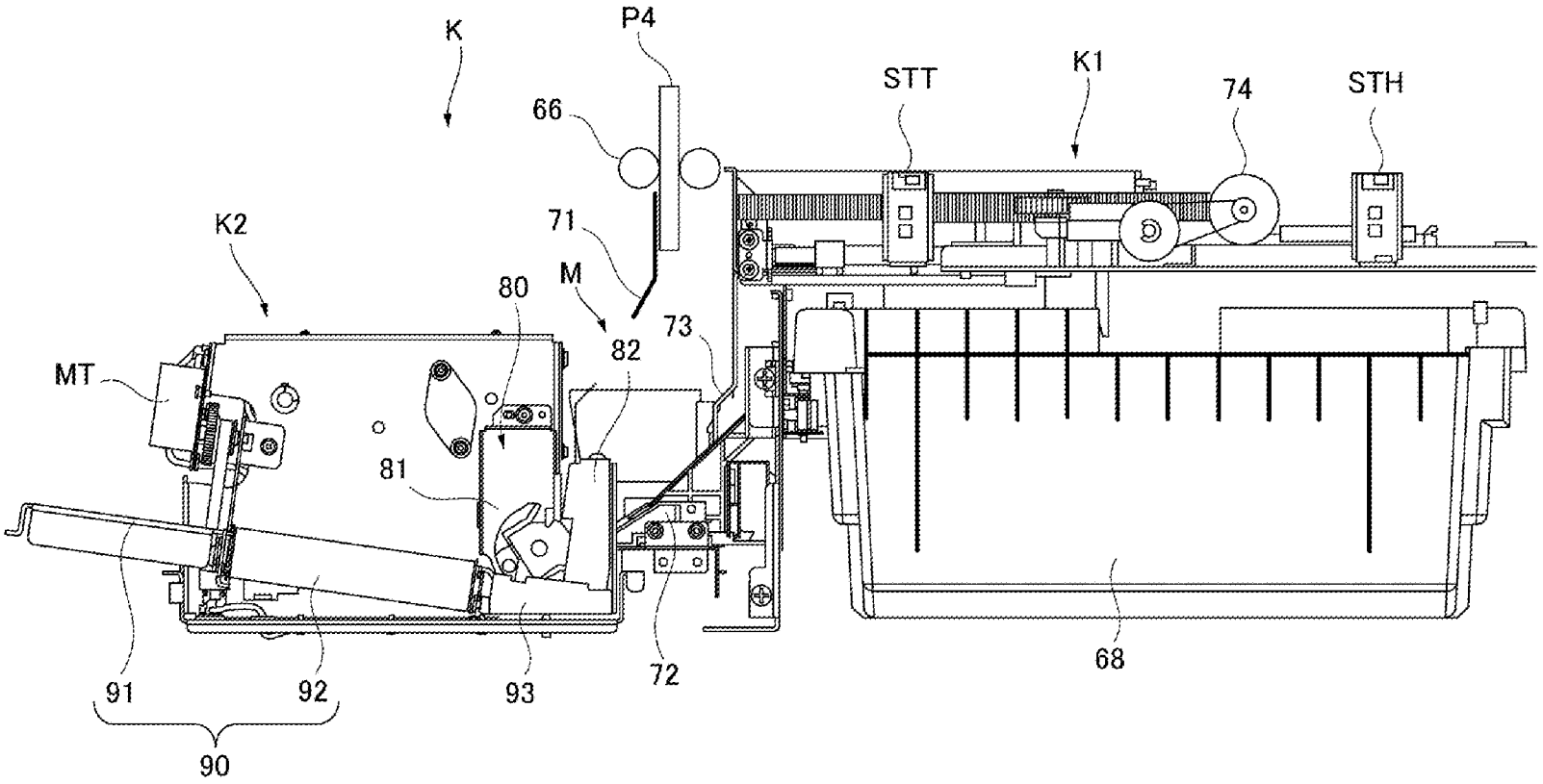
FIG. 5 is a schematic view of a sheet bundle discharging apparatus according to the embodiment of the present invention.
Figure 6:
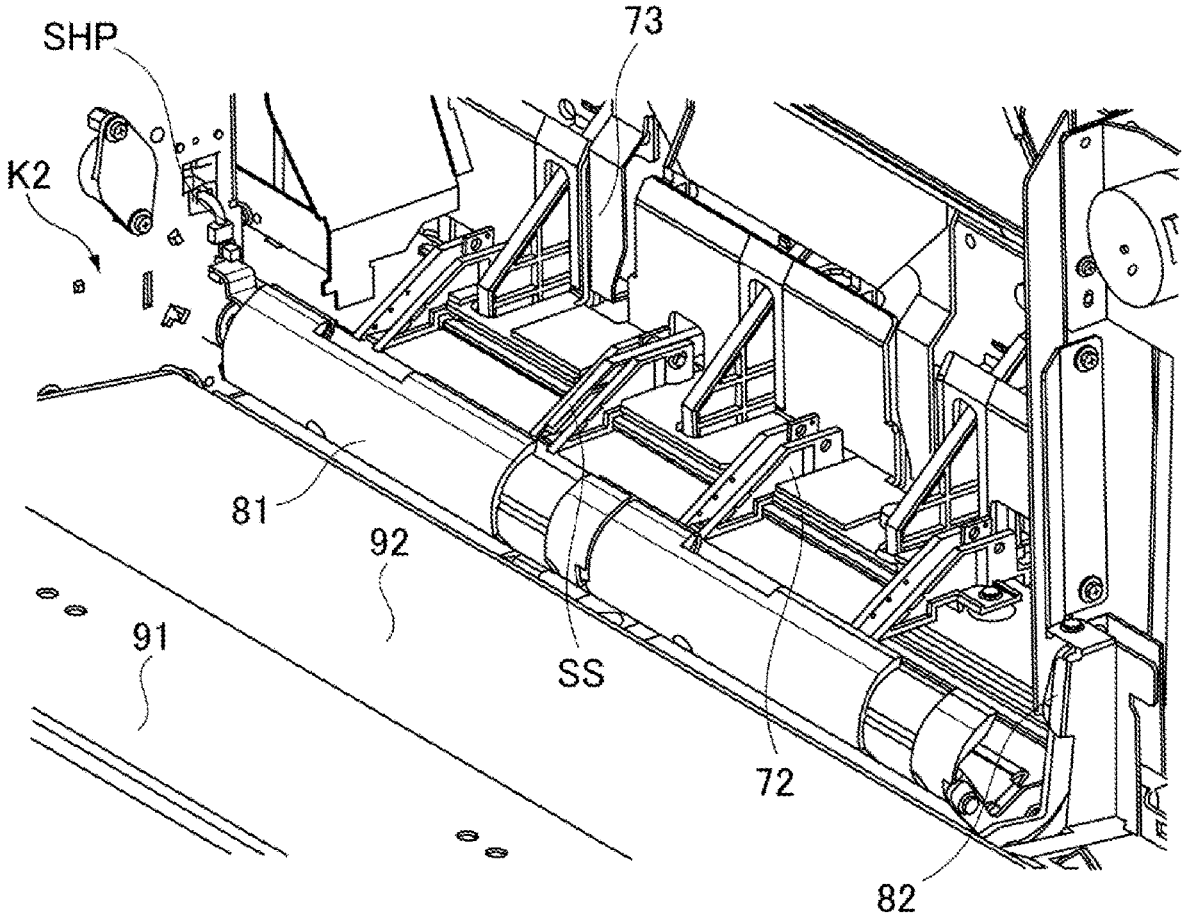
FIG. 6 is a view as seen in a direction indicated by an arrow M of FIG. 5.

FIG. 5 is a schematic view for illustrating the sheet bundle discharging apparatus K, and is an illustration of a state in which a spine receiver 81 waits at a position of receiving the booklet P4. FIG. 6 is a perspective view of a region including the spine receiver 81. In FIG. 5, the sheet bundle discharging portion K2 is arranged on a lower side (downstream side in the conveyance direction) with respect to the sheet bundle discharging roller pair 66 and the discharging guide 71. The sheet bundle discharging portion K2 includes a slope 72 and a spine receiver unit 80. The slope 72 is configured to allow the booklet P4, which is conveyed from the sheet bundle discharging roller pair 66 and the discharging guide 71, to slide thereon. The spine receiver unit 80 is configured to receive the booklet P4 conveyed through the discharging guide 71 and the slope 72. The spine receiver unit 80 that receives the booklet P4 conveyed thereto, rotates, and tilts the booklet P4 constitutes a receiving unit in this embodiment.

As illustrated in FIG. 5, in the spine receiver unit 80, the spine receiver 81 is held along a groove of a spine receiver rail 82 so as to be rotatable between a booklet receiving position BRP (FIG. 9A) that is a first position and a booklet discharging position BDP (FIG. 11) that is a second position. The spine receiver 81 is formed to be capable of receiving the booklet P4 when the spine receiver 81 is located at the booklet receiving position BRP. Then, the spine receiver 81 rotates from the booklet receiving position BRP to the booklet discharging position BDP, and places the booklet on a belt conveyor 90 described later.

As illustrated in FIG. 6, in the spine receiver unit 80, there is arranged a spine receiver home position sensor SHP configured to detect whether or not the spine receiver 81 is located at the booklet receiving position BRP. Moreover, in the spine receiver unit 80, a slope sensor SS capable of detecting that the booklet P4 is passed to the spine receiver 81 is arranged.

Moreover, as illustrated in FIG. 6, a thrust plate 73 is provided in the sheet bundle discharging portion K2. Through drive of a thrust plate driver 74, the thrust plate 73 can push the booklet P4 received by the spine receiver 81. A position at which the thrust plate 73 pushes the booklet is on an upstream side of the spine receiver unit 80 in the conveyance direction. A position of the thrust plate 73 is determined by a thrust plate home position sensor STH and a tilt position sensor STT, which are illustrated in FIG. 5. The thrust plate home position sensor STH detects that the thrust plate 73 is located at a home position (retreat position). The tilt position sensor STT detects that the thrust plate 73 is located at a tilt position. The tilt position is a position when the thrust plate 73 executes an operation of tilting the booklet P4. The thrust plate 73 and the thrust plate driver 74 constitute a tilt unit in this embodiment.

[Details of Spine Receiver]

Figure 7:
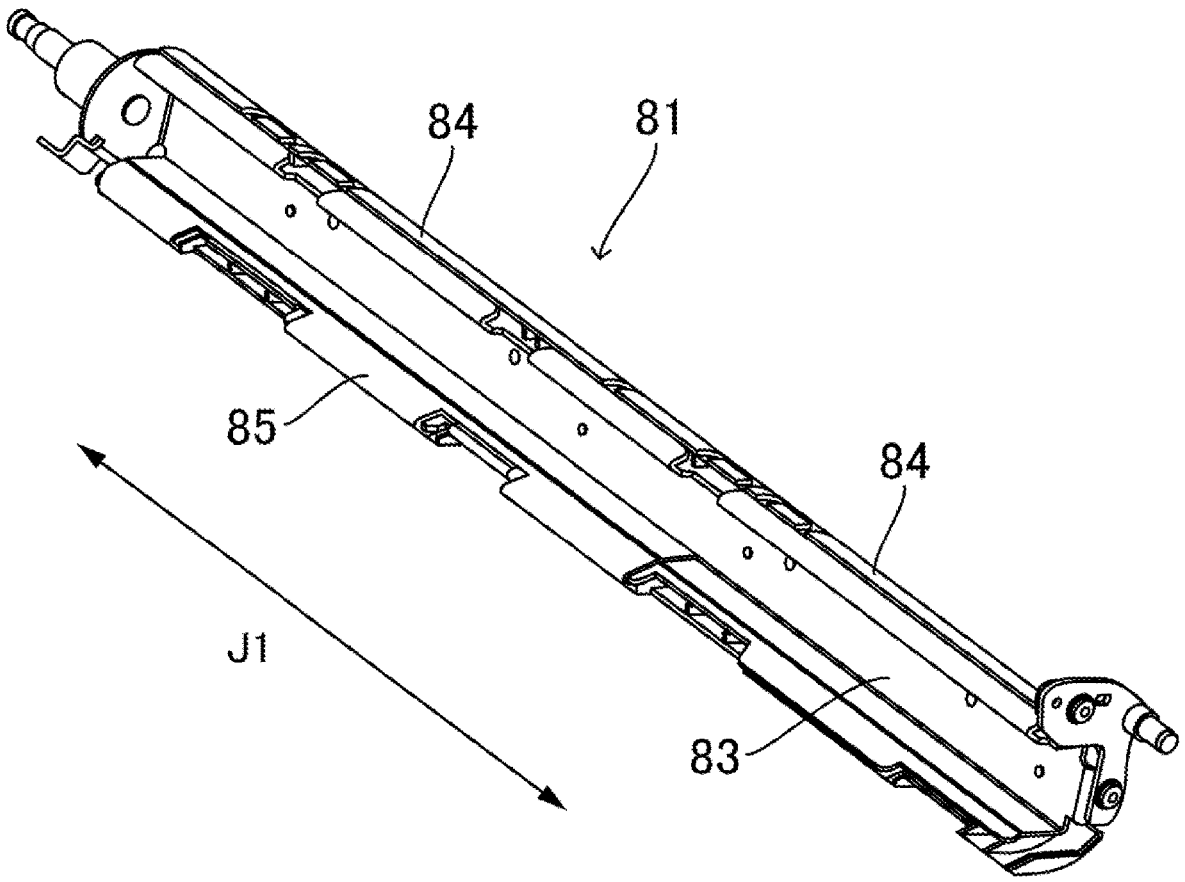
FIG. 7 is a schematic view of a spine receiver according to the embodiment of the present invention.

FIG. 7 is a schematic view for illustrating the spine receiver 81. As illustrated in FIG. 7, the spine receiver (receiving unit) 81 is formed of a spine receiver base 83, spine receiver guides 84, and a spine receiver sheet 85. The spine receiver base 83 is a member that extends in a J1 direction. The spine receiver guides 84 are arranged side by side in the J1 direction so as to cover an outer peripheral side of the spine receiver base 83. The spine receiver sheet 85 is affixed to the spine receiver base 83. The spine receiver sheet 85 is formed so that a length thereof in the J1 direction becomes longer than a length from a top portion to a base portion in a booklet with a maximum size achievable by the bookbinding apparatus B (see FIG. 1 and FIG. 2).

Figure 8:
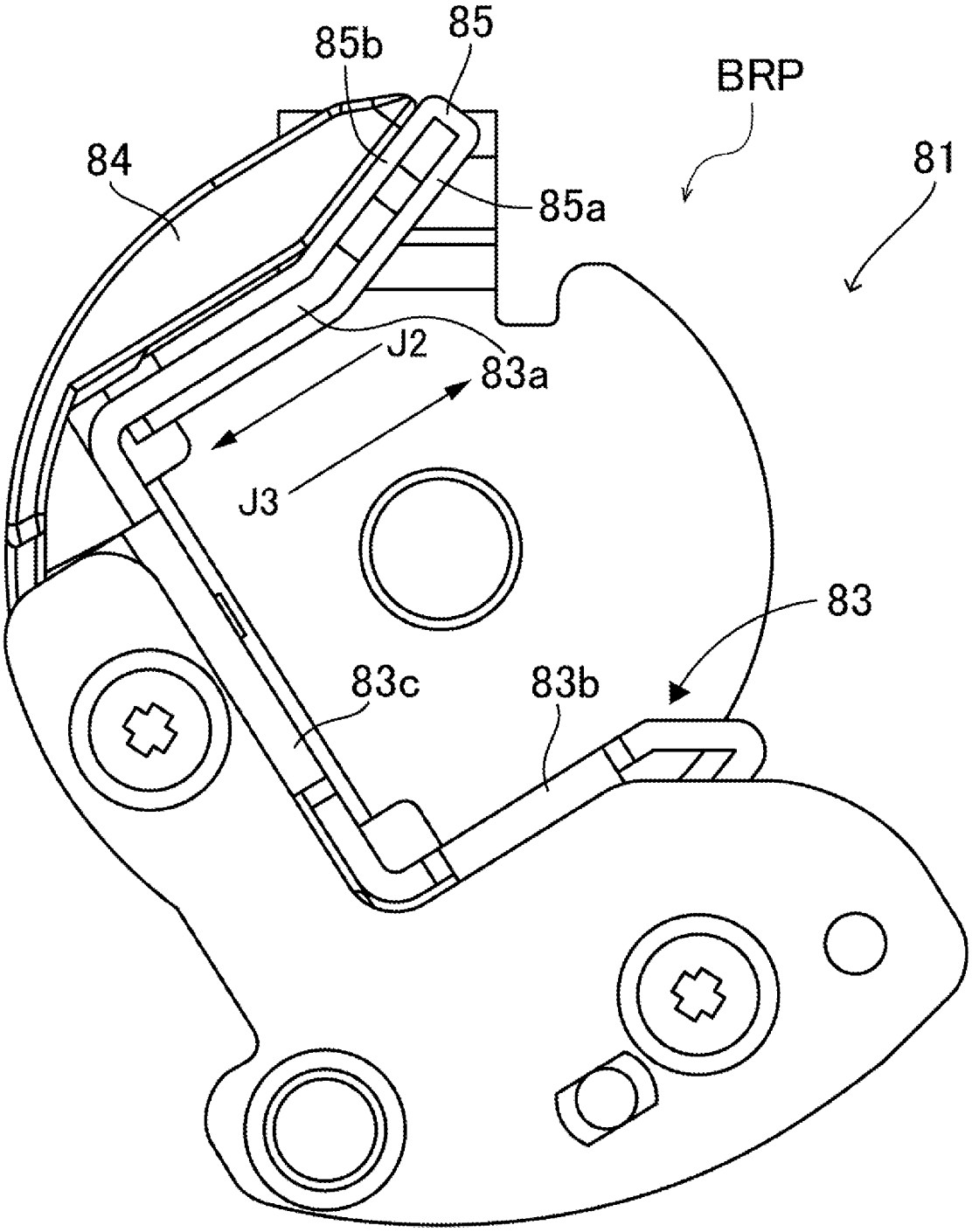
FIG. 8 is a side view of the spine receiver according to the embodiment of the present invention when the spine receiver is located at a booklet receiving position.

FIG. 8 is a side view when the spine receiver 81 is located at the booklet receiving position BRP.

The spine receiver 81 is formed so as to include three surfaces which are a first surface, a second surface, and a third surface. The spine receiver base 83 includes a spine receiver upper guide 83*a*, a spine receiver lower guide 83*b*, and a spine receiver bottom plate 83*c*. The spine receiver bottom plate 83*c* forms the first surface. The spine receiver lower guide 83*b* forms the second surface. A surface of the spine receiver sheet 85 affixed to (supported on) the spine receiver upper guide (support member) 83*a* forms the third surface. In this embodiment, the spine receiver base 83 is formed of a metal plate.

An arrow J2 in FIG. 8 indicates a direction in which the booklet approaches the first surface, and accordingly, is referred to as an "approaching direction J2". Then, an arrow J3 indicates a direction in which the booklet goes away from the first surface, and accordingly, is referred to as a "separating direction J3".

Functions to be carried out by the first surface, the second surface, and the third surface are as follows.

The spine receiver bottom plate 83*c* forms the first surface. When the spine receiver 81 is located at the booklet receiving position BRP, the first surface abuts against and receives a spine P4A (see FIG. 9A and FIG. 9B) of the booklet that moves in the approaching direction J2.

The spine receiver lower guide 83*b* forms the second surface. The second surface is formed substantially perpendicularly to the spine receiver bottom plate 83*c*. The second surface is a region slidable with respect to the booklet, which moves in the approaching direction J2, before the spine P4A of the booklet abuts against the first surface when the spine receiver 81 is located at the booklet receiving position BRP. Moreover, while the spine receiver 81 rotates from the booklet receiving position BRP (first position) to the booklet discharging position BDP (second position), an end portion of the second surface in the separating direction J3 pushes the booklet in a rotation direction of the spine receiver 81.

The spine receiver upper guide 83*a* is formed substantially perpendicularly to the spine receiver bottom plate 83*c* so as to be opposed to the spine receiver lower guide 83*b*. The spine receiver sheet 85 affixed to the spine receiver upper guide 83*a* forms the third surface. While the spine receiver 81 rotates from the booklet receiving position BRP (first position) to the booklet discharging position BDP (second position), the third surface regulates the movement of the booklet in the rotation direction of the spine receiver 81.

As illustrated in FIG. 8, the spine receiver sheet 85 as a friction member is arranged so as to cover the spine receiver upper guide 83*a* with an inner cover portion 85*a* and an outer cover portion 85*b*. The spine receiver sheet 85 is fixed by sticking the inner cover portion 85*a* to the spine receiver upper guide 83*a* and sandwiching the outer cover portion 85*b* by the spine receiver upper guide 83*a* and the spine receiver guides 84. The spine receiver sheet 85 is assembled as described above, thereby the spine receiver sheet 85 becomes less liable to peel off from the spine receiver upper guide 83*a*.

A direction and a friction coefficient in which the booklet moves while abutting against the spine receiver sheet 85 is described. A friction coefficient between the spine receiver sheet 85 and the booklet in the approaching direction J2 is defined as a friction coefficient μJ2. Then, a friction coefficient between the spine receiver sheet 85 and the booklet in the separating direction J3 is defined as a friction coefficient μJ3.

A larger value of the friction coefficient μJ3 is preferable. This is in order to suppress, by frictional force, the booklet having abutted against the spine receiver sheet from moving in the separating direction J3 at a time of a booklet discharging operation described later. By suppressing the booklet from moving in the separating direction J3, the booklet is not detached from the spine receiver unit 80, and the booklet can be stably discharged. Meanwhile, a smaller value of the friction coefficient μJ2 is preferable. This is in order to prevent hindering entry of the booklet into the spine receiver unit 80 even if the booklet that moves in the approaching direction J2 contacts the spine receiver sheet 85.

In the spine receiver sheet 85, the friction coefficient μJ3 between the booklet and the spine receiver sheet 85 in the separating direction J3 is preferably larger than a friction coefficient between the spine receiver bottom plate 83*c* and the booklet.

In the spine receiver sheet 85, the friction coefficient μJ3 between the booklet and the spine receiver sheet 85 in the separating direction J3 is preferably larger than the friction coefficient μJ2 between the booklet and the spine receiver sheet 85 in the approaching direction J2 in the spine receiver sheet 85.

In this embodiment, the spine receiver sheet 85 is formed so that the friction coefficients μJ2 and μJ3 are different from each other. Specifically, a flocking sheet or a hair implanted sheet (hereinafter referred to as an implanted sheet) is used as the spine receiver sheet 85. The implanted sheet is a flocking sheet having a surface provided with short hair. The implanted sheet has a small friction coefficient in a forward direction pursuant to a hair implantation direction (hereinafter referred to as an implantation direction) and a large friction coefficient in a reverse direction opposite to the implantation direction. Therefore, the implanted sheet is placed so that a direction in which hair extends becomes the approaching direction J2.

It is not always required that the friction coefficients μJ2 and μJ3 differ from each other in the inner cover portion 85*a*, and the friction coefficients μJ2 and μJ3 may be the same value. A reason for this is that this affects a little if the booklet that moves in the approaching direction J2 is less liable to contact the spine receiver sheet 85.

[Details of Discharging Operation of Booklet]

Figure 9A:
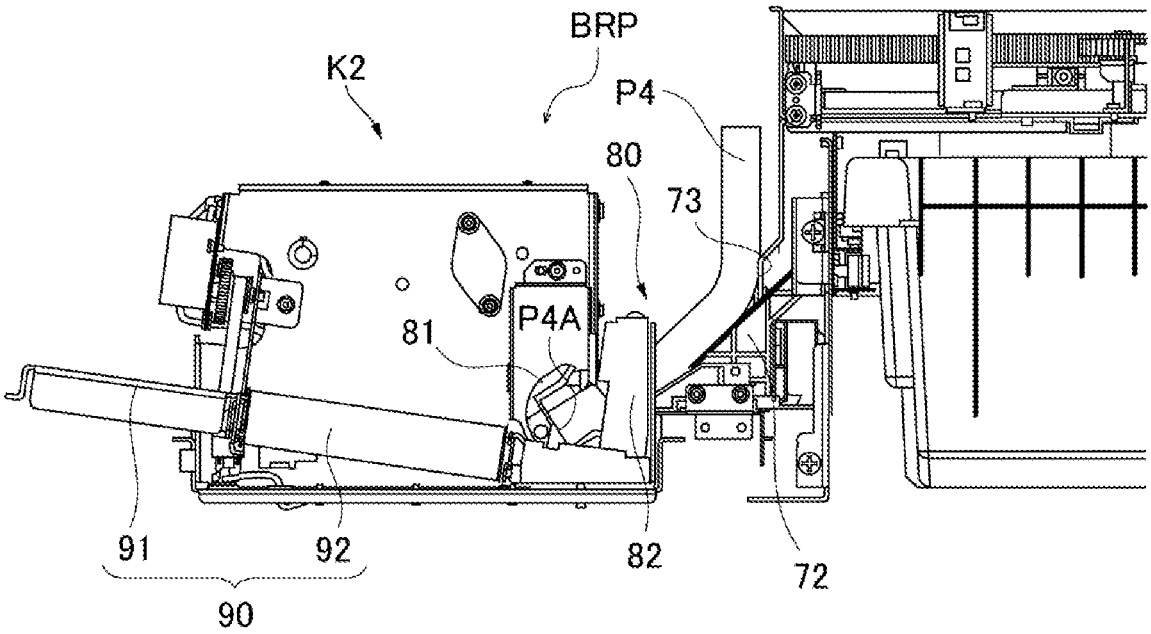
FIG. 9A is a view for illustrating a state in which a spine receiver unit receives a booklet in the sheet bundle discharging apparatus according to the embodiment of the present invention.
Figure 9B:
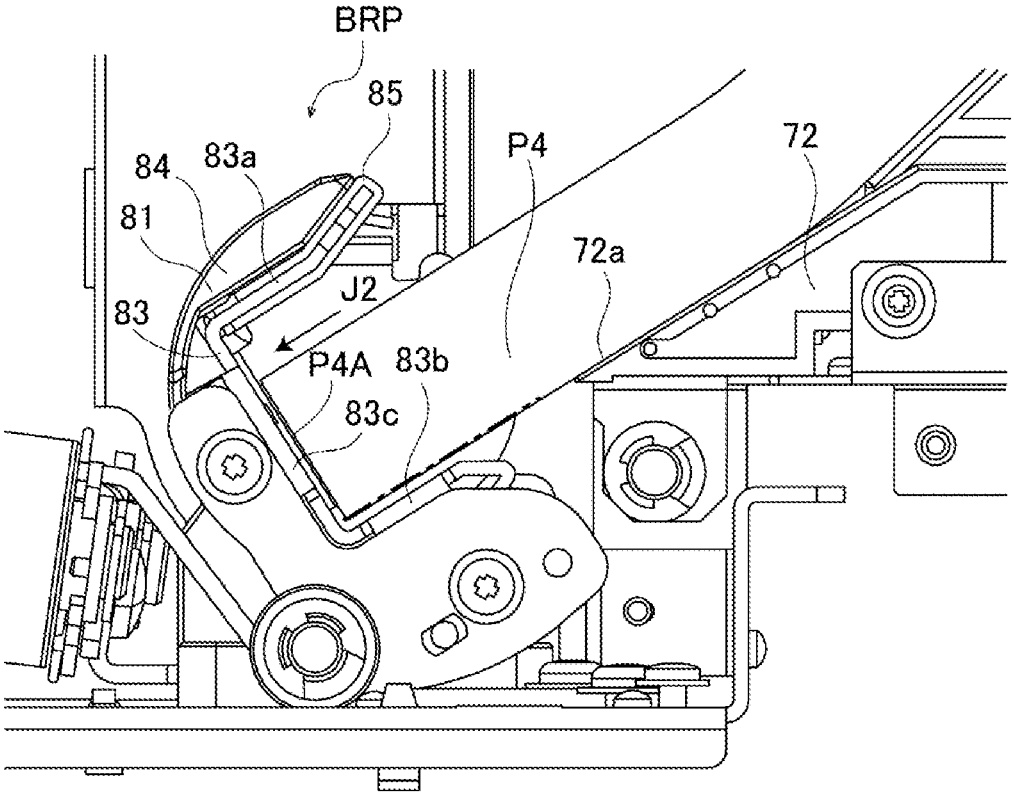
FIG. 9B is an enlarged view of the spine receiver unit in the state of FIG. 9A.

FIG. 9A is a schematic view for illustrating a state in which the booklet P4 is received by the spine receiver 81. FIG. 9B is an enlarged view of the spine receiver 81 in the state illustrated in FIG. 9A, in which the booklet P4 is received by the spine receiver 81. The booklet P4 conveyed to the sheet bundle discharging portion K2 slides on an inclined slope surface 72*a* of the slope 72 and is conveyed to the spine receiver unit 80 when the spine receiver home position sensor SHP detects that the spine receiver 81 is located at the booklet receiving position BRP. In the booklet P4 conveyed toward the spine receiver unit 80, the spine P4A that becomes a downstream end portion in the conveyance direction abuts against the spine receiver 81 and stops.

As illustrated in FIG. 9B, the spine receiver lower guide 83*b* is located at a position that is substantially parallel to the inclined slope surface 72*a* and does not project to the booklet side in the booklet receiving position BRP. With this configuration, the booklet P4 is smoothly inserted into the spine receiver 81. Moreover, since the spine receiver bottom plate 83*c* and the spine receiver lower guide 83*b* are substantially perpendicular to each other, the attitude of the booklet P4 is stabilized in a state in which the spine P4A of the booklet P4 abuts against the first surface formed of the spine receiver bottom plate 83*c*.

When the booklet P4 moves in the approaching direction J2, the booklet P4 may possibly slide with respect to the second surface formed of the spine receiver lower guide 83*b*. When the booklet P4 slides with respect to the spine receiver lower guide 83*b*, movement of the booklet P4 is hindered when a friction coefficient between the booklet P4 and the second surface is large. Therefore, in this embodiment, the surface of the spine receiver base 83 formed of a metal plate is exposed to reduce the friction coefficient between the booklet P4 and the second surface. In this embodiment, the friction coefficient between the booklet P4 and the second surface is a smaller value than the friction coefficient μJ2 and the friction coefficient μJ3, which are mentioned above.

Like the spine receiver lower guide 83*b*, the spine receiver bottom plate 83*c* is formed so that the surface of the spine receiver base 83 is exposed. Therefore, a friction coefficient between the booklet P4 and the first surface formed of the spine receiver bottom plate 83*c* can be reduced.

The spine receiver 81 according to this embodiment is formed so that the third surface formed of the spine receiver upper guide 83*a* to which the spine receiver sheet 85 is affixed has a different friction coefficient from those of the second surface formed of the spine receiver lower guide 83*b* and the first surface formed of the spine receiver bottom plate 83*c*. In this embodiment, the friction coefficient between the booklet P4 and the first surface is a smaller value than the friction coefficient μJ2 and the friction coefficient μJ3.

Moreover, an interval between the spine receiver upper guide 83*a* and the spine receiver lower guide 83*b* is wider than a maximum thickness of a booklet for which the bookbinding apparatus B is capable of performing bookbinding. Therefore, even the booklet with the maximum thickness can be inserted into the spine receiver 81.

[Attitude Change of Booklet]

The slope sensor SS (see FIG. 6) detects that the booklet P4 is inserted into the spine receiver 81. After the booklet P4 is inserted into the spine receiver 81, the bookbinding apparatus controller 102 (see FIG. 14) drives a discharge motor MT (see FIG. 14), which is coupled to the spine receiver 81 by a drive train (not shown), to rotate forward at a predetermined speed, and rotates the spine receiver 81 counterclockwise. The bookbinding apparatus controller 102 controls the discharge motor MT by motor pulse control.

Figure 10A:
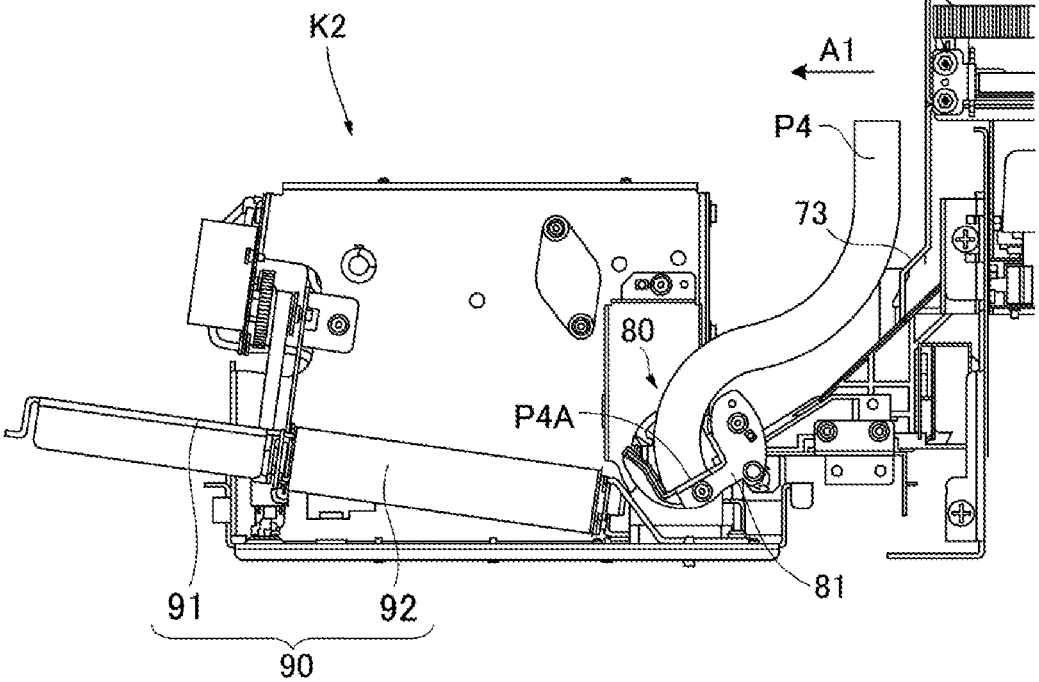
FIG. 10A is a view for illustrating a state in which the spine receiver unit receives the booklet and starts rotation in the sheet bundle discharging apparatus according to the embodiment of the present invention.
Figure 10B:
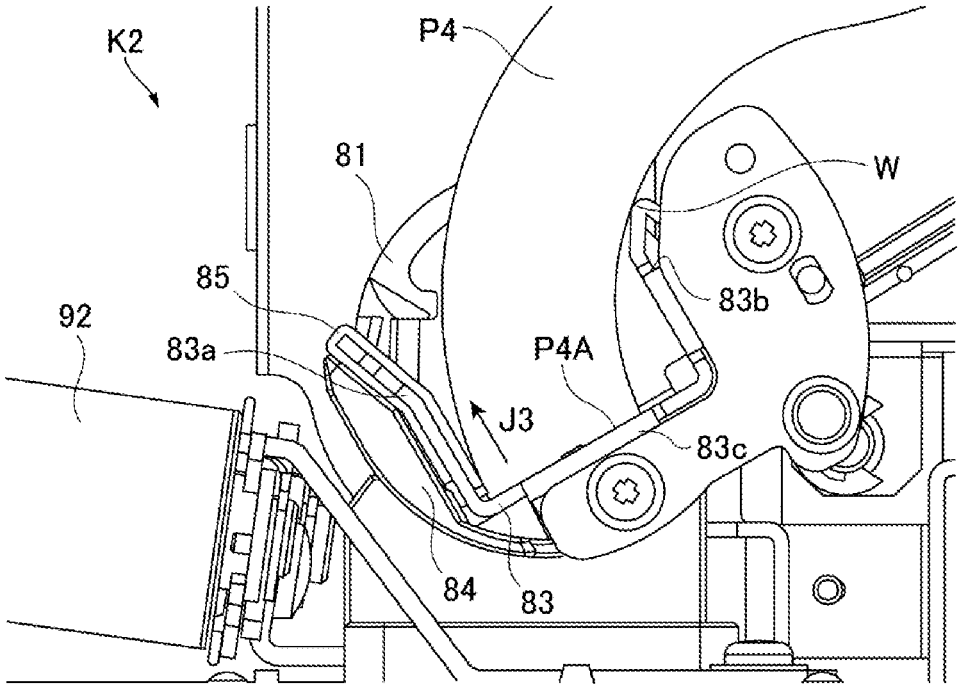
FIG. 10B is an enlarged view of the spine receiver unit in the state of FIG. 10A.

FIG. 10A is a schematic view for illustrating a state in which the spine receiver 81 is rotated counterclockwise by a predetermined angle by the discharge motor MT. FIG. 10B is an enlarged view of the spine receiver 81 in the state illustrated in FIG. 10A, in which the spine receiver 81 is rotated counterclockwise by a predetermined angle.

As illustrated in FIG. 10A, when the spine receiver 81 rotates at a predetermined angle, an end portion W of the spine receiver lower guide 83*b* that forms the second surface abuts against the booklet P4. Then, the end portion Win the separating direction J3 pushes the booklet P4 in the rotation direction of the spine receiver 81. An attitude of the pushed booklet P4 is curved. Then, the curved booklet P4 on the spine P4A side moves. The booklet P4 having moved abuts against the third surface formed of the spine receiver sheet 85 affixed to the spine receiver upper guide 83*a*. As described above, the third surface abuts against the booklet P4 and regulates the movement of the booklet P4. Then, as illustrated in FIG. 10B, a frictional force to inhibit the booklet P4 from moving in the separating direction J3 is generated. The frictional force that acts between the spine receiver sheet 85 and the booklet P4 that moves in the separating direction J3 is generated according to the friction coefficient μJ3. Due to this frictional force, the booklet P4 becomes difficult to move in the separating direction J3 while such a spine receiver 81 is rotating.

When the spine receiver 81 is rotated, the spine P4A of the booklet P4 slides on the spine receiver bottom plate 83*c*, and the booklet P4 and the spine receiver sheet 85 abut against each other. Therefore, a smaller friction coefficient between the booklet P4 and the spine receiver bottom plate 83*c* is preferable so that the booklet P4 and the spine receiver sheet 85 abut against each other. In this embodiment, the surface of the metal plate is exposed.

In this embodiment, the friction coefficients μJ2 and μJ3 are set larger than the friction coefficient between the booklet P4 and the spine receiver bottom plate 83*c*. At least the friction coefficient μJ3 is set larger than the friction coefficient between the booklet P4 and the spine receiver bottom plate 83*c*, thereby the booklet P4 can be tilted stably.

The bookbinding apparatus controller 102 drives the thrust plate driver 74 in synchronization with the rotation of the spine receiver 81, and moves the thrust plate 73 in an A1 direction in FIG. 10A. The thrust plate 73 abuts against and pushes the booklet P4, and tilts the booklet P4. Such a bookbinding apparatus controller 102 moves the thrust plate 73 to a position of tilting the booklet P4 while rotating the spine receiver 81 to a position of discharging the booklet P4.

Figure 11:
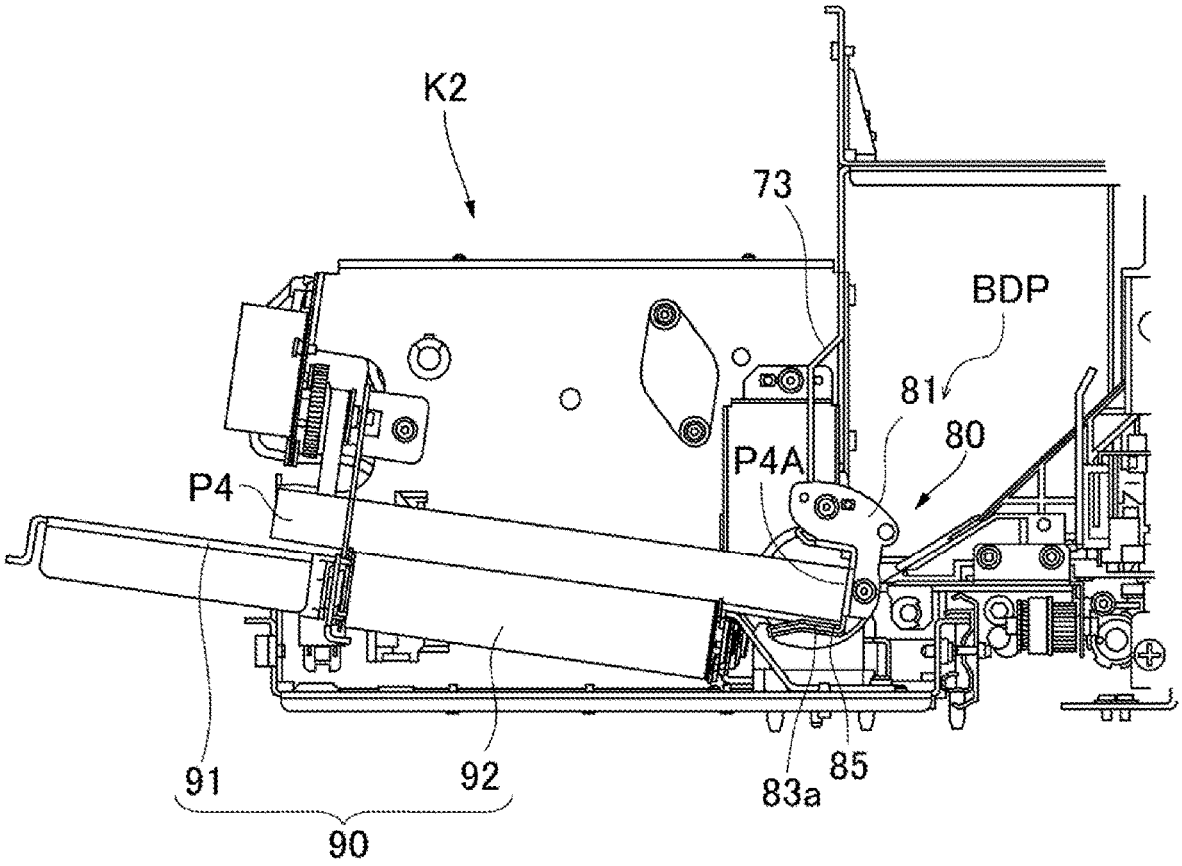
FIG. 11 is a side view for illustrating a state in which the booklet is placed on a belt conveyor in the sheet bundle discharging apparatus according to the embodiment of the present invention.

FIG. 11 is a view for illustrating a state in which the rotation of the spine receiver 81 and such a thrusting operation of the thrust plate 73 are completed and the booklet P4 is placed on the belt conveyor 90. By the rotation of the spine receiver 81 and the movement of the thrust plate 73, the booklet P4 is placed on the belt conveyor 90 as a discharging unit.

The spine receiver 81 stops in a state of having rotated up to the booklet discharging position BDP that is a second position illustrated in FIG. 11. At the booklet discharging position BDP, the spine receiver upper guide 83*a* becomes substantially parallel to a placing surface of a conveyance belt 92, on which the booklet P4 is to be placed. Moreover, at this time, the spine receiver upper guide 83*a* to which the spine receiver sheet 85 is affixed is located at a position of not projecting a front surface side of the placing surface of the conveyance belt 92. Therefore, when the spine receiver 81 is located at the booklet discharging position BDP, there is a gap between the third surface that is the surface of the spine receiver sheet 85 and the booklet P4 placed on the belt conveyor 90, and the third surface and the booklet P4 do not contact each other. Hence, the booklet P4 and the spine receiver sheet 85 do not contact each other when the conveyance belt 92 is driven to discharge the booklet P4, and accordingly, the booklet P4 is not damaged.

The belt conveyor 90 is formed by winding the conveyance belt 92 around a belt stay 91. The belt conveyor 90 is placed to be tilted by a predetermined angle so that the spine P4A side of the booklet P4 placed thereon is located on the lower side. In other words, the belt conveyor 90 is placed so that the spine receiver unit 80 side is located on the lower side. By this tilt, the booklet P4 can be suppressed from shifting in the tilted direction when the booklet P4 is tilted and placed on the belt conveyor 90.

[Conveyance of Booklet to Outside of Apparatus]

Figure 12:
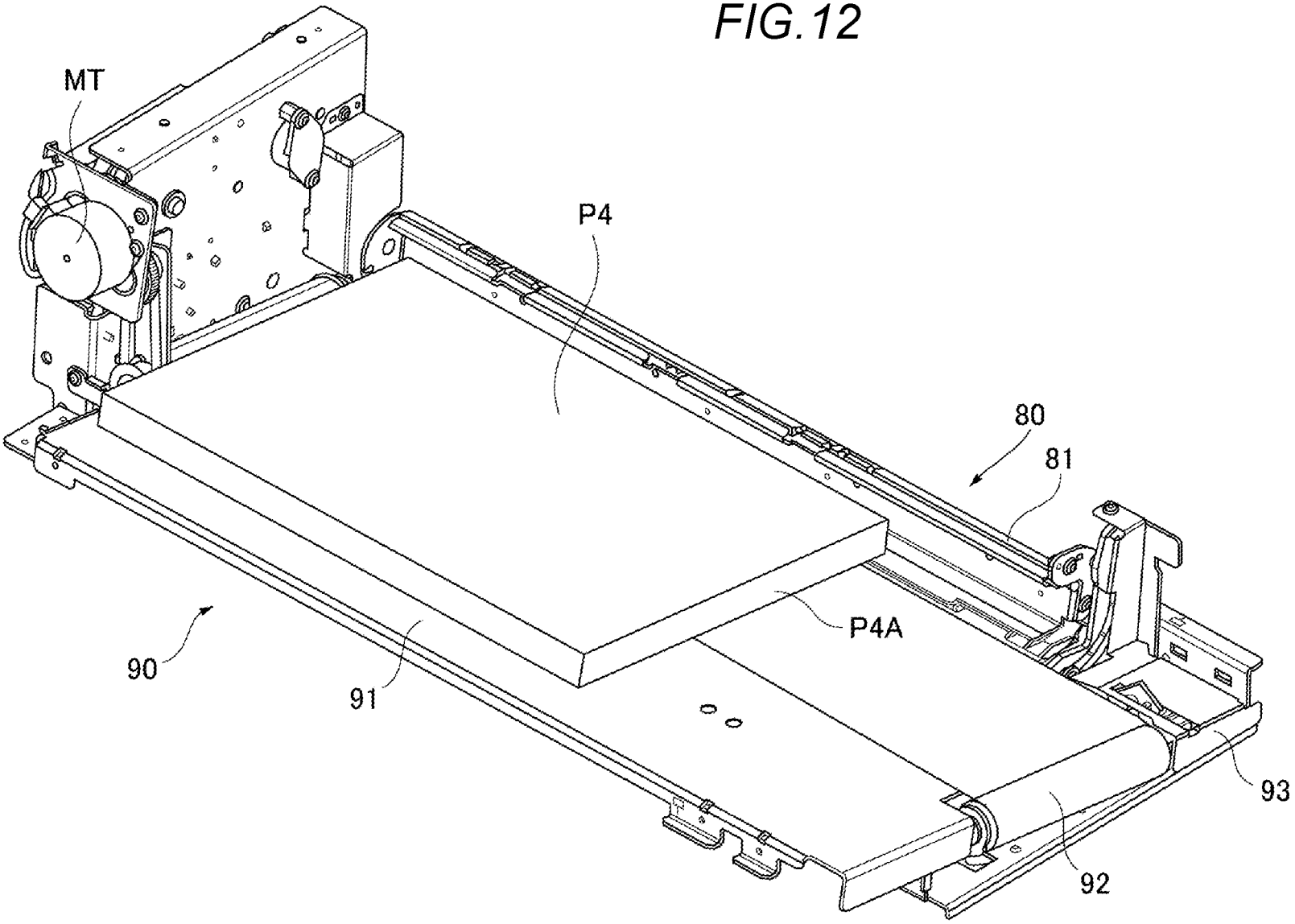
FIG. 12 is a schematic view for illustrating the state in which the booklet is placed on the belt conveyor in the sheet bundle discharging apparatus according to the embodiment of the present invention.

FIG. 12 is a view for illustrating a state in which the booklet P4 is placed on the belt conveyor 90. As mentioned above, the belt conveyor 90 is formed of: the conveyor stay 91; the conveyance belt 92 configured to convey the booklet P4 placed thereon; and a discharge detector 93 configured to detect whether or not the booklet P4 is conveyed to the outside of the apparatus. The conveyance belt 92 is coupled to the discharge motor MT by the drive train (not shown), and is rotated in a direction (discharging direction) of discharging the booklet P4 to the outside of the apparatus in such a manner that the discharge motor MT is driven to rotate reversely.

Figure 13:
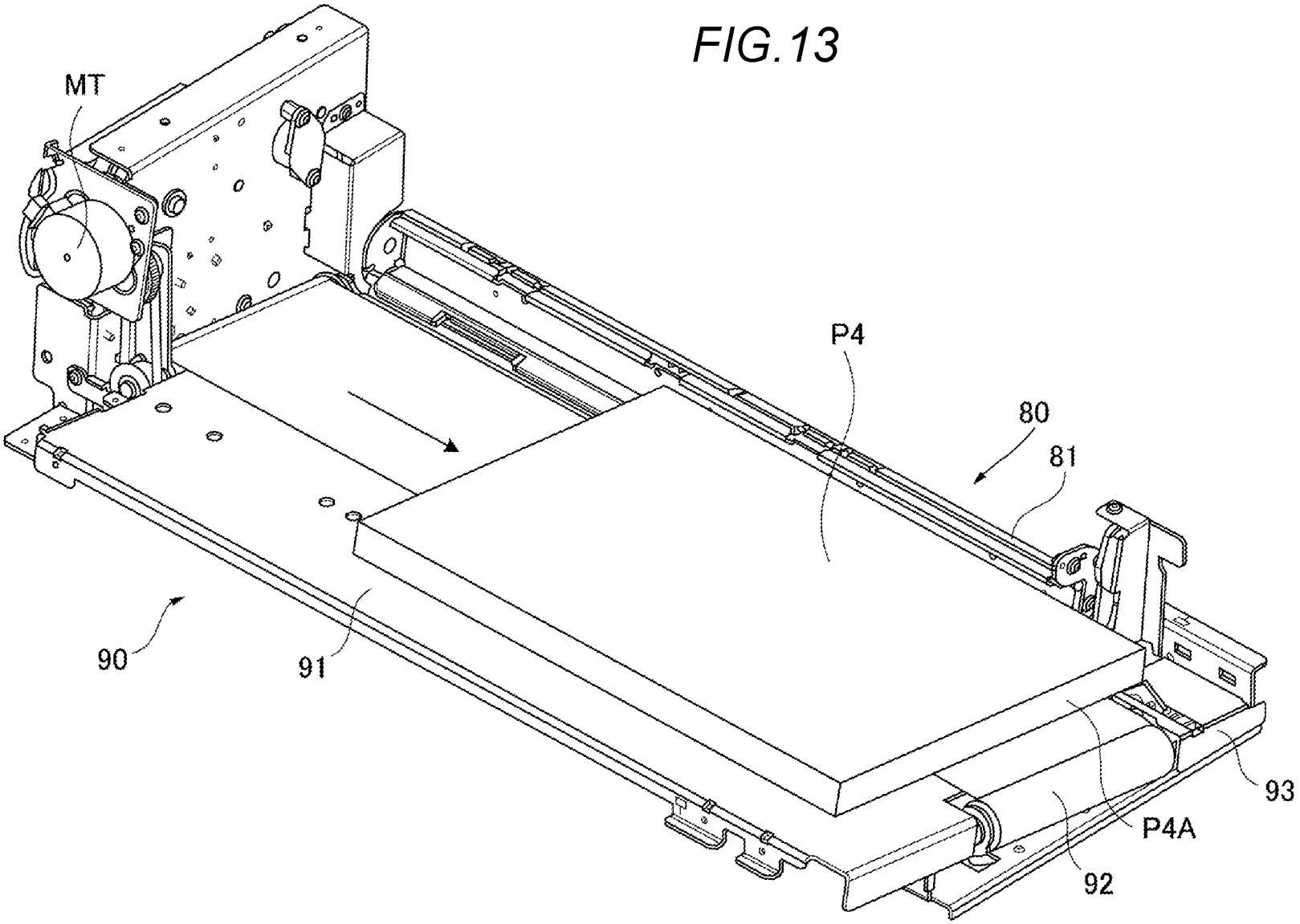
FIG. 13 is a schematic view for illustrating a state in which, in the sheet bundle discharging apparatus according to the embodiment of the present invention, the booklet placed on the belt conveyor is conveyed to the outside of the apparatus.

Herein, when the booklet P4 is tilted and placed on the belt conveyor 90 in a state in which the conveyance belt 92 is rotating, the booklet P4 abuts against the conveyance belt 92 that is moving. Then, the booklet P4 on the belt conveyor 90 is placed in an attitude tilted with respect to a travel direction of the conveyance belt 92. When the booklet P4 is placed while being tilted too much, the discharge detector 93 may become incapable of detecting the discharge of the booklet P4. Accordingly, the bookbinding apparatus controller 102 tils the booklet P4 in a state in which the conveyance belt 92 is stopped as illustrated in FIG. 12. Then, after the booklet P4 is placed on the belt conveyor 90, the bookbinding apparatus controller 102 rotates the conveyance belt 92 as illustrated in FIG. 13, and discharges the booklet P4 to the outside of the apparatus.

By the discharge detector 93, the bookbinding apparatus controller 102 detects that the booklet P4 is discharged to the outside of the apparatus. When the booklet P4 is discharged to the outside of the apparatus, the bookbinding apparatus controller 102 stops the rotation of the conveyance belt 92. Thereafter, the bookbinding apparatus controller 102 returns the position of the spine receiver 81 to the booklet receiving position BRP, and moves the thrust plate 73 to the retreat position. At this point of time, a series of operations related to the conveyance of the booklet P4 to the outside of the apparatus is ended, and in addition, preparation of receiving a booklet that follows is completed. Then, when there is a booklet to be conveyed next, the operations according to the respective configurations mentioned above are executed again. As described above, the bookbinding apparatus B according to this embodiment can continuously discharge the booklets to the outside of the apparatus.

The configuration of the spine receiver 81 in this embodiment is summarized. The spine receiver 81 includes: the first surface formed of the spine receiver bottom plate 83*c*; the second surface formed of the spine receiver lower guide 83*b*; and the third surface formed of the spine receiver sheet 85 as the friction member to which the spine receiver upper guide 83*a* is affixed. In order to stably discharge the booklet P4, a larger value is preferable as the friction coefficient μJ3 between the spine receiver sheet 85 and the booklet P4 in the separating direction J3. Moreover, in order to prevent influence on the movement of the booklet P4 to the spine receiver 81, a smaller value is preferable as the friction coefficient μJ2 between the spine receiver sheet 85 and the booklet P4 in the approaching direction J2. Then, a smaller value is preferable as the friction coefficient between the spine receiver bottom plate 83*c* and the booklet P4. This is in order to make it easy to move the spine P4A of the booklet P4 when the spine receiver 81 is rotated, and to stably tilt the booklet P4 by allowing the booklet P4 and the spine receiver sheet 85 to abut against each other at that time.

With such a configuration, the bookbinding apparatus B (see FIG. 1 and FIG. 2) according to this embodiment can achieve continuous bookbinding and continuous conveyance of the booklet to the outside of the apparatus. With this, the bookbinding apparatus B can independently operate the bookbinding system even in a case of printing a large amount of bookbinding bundles with the same condition. Moreover, the bookbinding apparatus B according to this embodiment tilts the booklet P4 before conveying the booklet P4 to the outside of the apparatus by the belt conveyor 90. Therefore, the conveyance passage of the booklet P4 can be shortened in comparison with a configuration of turning the attitude of the booklet P4 from an erected state to a tilted state while conveying the booklet P4. Accordingly, the apparatus can be downsized.

[Control Block Diagram]

Figure 14:
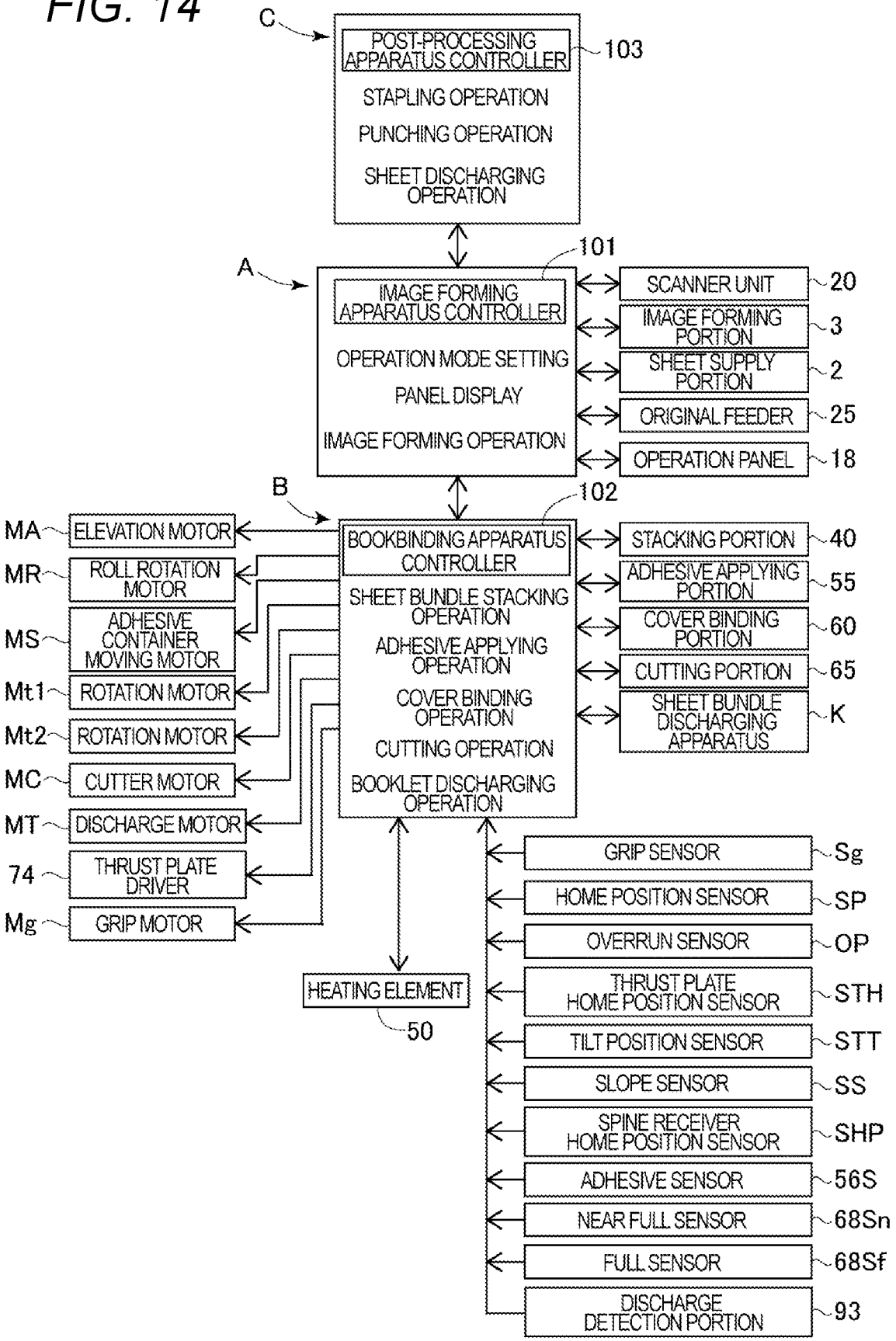
FIG. 14 is a control block diagram of the image forming apparatus according to the embodiment of the present invention.

FIG. 14 is a control block diagram for illustrating the image forming system in this embodiment. As illustrated in FIG. 14, the image forming apparatus controller 101 is provided in the image forming apparatus A. The image forming apparatus controller 101 controls the sheet supply portion 2, the image forming portion 3, the original feeder 25, and the scanner unit 20 based on image formation information input to the operation panel 18 by a user, to thereby allow the image forming apparatus A to perform an image forming operation. The bookbinding apparatus controller 102 is provided in the bookbinding apparatus B. The bookbinding apparatus controller 102 controls rotation of the motors through detection operations of the sensors to control the stacking portion 40, the adhesive applying portion 55, the cover binding portion 60, the cutting portion 65, and the sheet bundle discharging apparatus K, to thereby allow the bookbinding apparatus B to perform a bookbinding operation. The post-processing apparatus controller 103 is provided in the post-processing apparatus C. The post-processing apparatus controller 103 controls the post-processing apparatus C to perform at least one post-processing such as stapling, punching, and stamping on sheets having been subjected to image formation. The image forming apparatus controller 101, the bookbinding apparatus controller 102, and the post-processing apparatus controller 103 may be integrated and provided at any location in the image forming system D. Moreover, the operation panel 18 may be connected to the bookbinding apparatus controller 102, or may be provided in the bookbinding apparatus B or the sheet bundle discharging apparatus K. This operation panel 18 constitutes a display unit capable of displaying information in this embodiment.

As described above, in the sheet bundle discharging apparatus K according to this embodiment, the friction coefficient J3 between the booklet P4 and the spine receiver sheet 85 affixed to the surface of the spine receiver upper guide 83*a* is higher than the friction coefficient between the booklet P4 and the spine receiver bottom plate 83*c*. Therefore, the sheet bundle discharging apparatus K can improve stability of the operation of tilting the booklet P4 from the spine receiver 81 toward the belt conveyor 90.

Modification Example

In this embodiment, the spine receiver sheet 85 is affixed to the surface of the spine receiver upper guide 83*a*, thereby the spine receiver 81 has J2 and μJ3 as friction coefficients larger than the friction coefficient of the surface of the spine receiver lower guide 83*b* and the friction coefficient of the surface of the spine receiver bottom plate 83*c*. However, the present invention is not limited to this. In the spine receiver 81, the surface of the spine receiver upper guide 83*a* may be processed into a groove shape, or the surface may be roughened to be satin-finished, thereby the friction coefficient of the surface of the spine receiver upper guide 83*a* may be set to a friction coefficient larger than the friction coefficient of the surface of the spine receiver lower guide 83*b* and the friction coefficient of the surface of the spine receiver bottom plate 83*c*. When such a configuration is given, the surface of the spine receiver upper guide 83*a* forms the third surface.

Moreover, in this embodiment, the spine receiver 81 has three surfaces, which are the spine receiver upper guide 83*a*, the spine receiver lower guide 83*b*, and the spine receiver bottom plate 83*c*. However, the present invention is not limited to this. For example, the spine receiver 81 may be formed to have two surfaces, which are the spine receiver lower guide 83*b* and a surface in which one end is connected to the spine receiver lower guide 83*b* substantially perpendicularly thereto, and is curved, and in which another end is substantially parallel to the spine receiver lower guide 83*b*.

Moreover, in this embodiment, in the spine receiver 81, the spine receiver sheet 85 is affixed to the surface of the spine receiver upper guide 83*a*. Meanwhile, an elastic member elastically deformable may be placed between the spine receiver upper guide 83*a* and the spine receiver sheet 85. When the elastic member is placed, the portion of the spine receiver sheet 85, against which the booklet P4 has abutted, is deformed when the spine receiver 81 is rotated to tilt the booklet P4. The deformation of the spine receiver sheet 85 makes it easy to bring the spine receiver sheet 85 and the booklet P4 into intimate contact with each other. Then, the deformation of the spine receiver sheet 85 makes it difficult to allow the booklet P4 to come off from the spine receiver 81 at the time of tilting the booklet P4. The spine receiver sheet 85 itself may be formed of a material that is elastically deformed.

Moreover, in this embodiment, the sheet bundle discharging apparatus K is formed so as to tilt the booklet P4 by using the spine receiver 81 of the spine receiver unit 80 and the thrust plate 73; however, may be formed so as to tilt the booklet P4 by only the spine receiver 81. Moreover, the sheet bundle discharging apparatus K may be formed so as to grip the fore edge side of the booklet P4 by a gripper and to tilt the booklet P4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-232583, filed Dec. 12, 2018, and Japanese Patent Application No. 2019-212368, filed Nov. 25, 2019, which are hereby incorporated by reference herein in their entirety.

What is claimed is:

1. A sheet bundle discharging apparatus configured to discharge a sheet bundle including a spine, the sheet bundle discharging apparatus comprising:

a conveyance unit configured to convey the sheet bundle;

a guide unit configured to guide the sheet bundle conveyed by the conveyance unit so that the spine is located at a leading end;

a receiving unit configured to receive the spine of the sheet bundle guided by the guide unit; and a discharging unit configured to discharge the sheet bundle to an outside of the sheet bundle discharging apparatus, wherein the receiving unit is rotatable between a first position and a second position, wherein the receiving unit receives the spine at the first position, wherein the receiving unit rotates from the first position to the second position to place the sheet bundle on the discharging unit, wherein the receiving unit includes:

a first surface against which the spine abuts when the receiving unit receives the spine at the first position;

a second surface on which the sheet bundle is slidable before the spine abuts against the first surface, the second surface being configured to push the sheet bundle in a rotation direction of the receiving unit while the receiving unit rotates from the first position to the second position; and a third surface which is arranged so as to be opposed to the second surface, the third surface being configured to regulate a movement of the sheet bundle in the rotation direction of the receiving unit while the receiving unit rotates from the first position to the second position, and wherein a friction coefficient between the sheet bundle and the third surface in a direction away from the first surface on the third surface is larger than a friction coefficient between the first surface and the sheet bundle.

2. The sheet bundle discharging apparatus according to claim 1, wherein the second surface and the third surface are formed substantially perpendicularly to the first surface.

3. The sheet bundle discharging apparatus according to claim 1, wherein the friction coefficient between the sheet bundle and the third surface in the direction away from the first surface on the third surface is larger than a friction coefficient between the sheet bundle and the third surface in a direction approaching the first surface on the third surface.

4. The sheet bundle discharging apparatus according to claim 3, wherein the friction coefficient between the sheet bundle and the third surface in the direction approaching the first surface is larger than the friction coefficient between the first surface and the sheet bundle.

5. The sheet bundle discharging apparatus according to claim 1, wherein, when the receiving unit is located at the second position, there is a gap between the third surface of the receiving unit and the sheet bundle placed on the discharging unit.

6. The sheet bundle discharging apparatus according to claim 1, wherein the third surface is formed of a member which is elastically deformable when abutting against the sheet bundle.

7. The sheet bundle discharging apparatus according to claim 1, wherein the receiving unit includes a sheet and a support member configured to support the sheet, and the third surface is a surface of the sheet.

8. The sheet bundle discharging apparatus according to claim 7, wherein the sheet has a surface provided with hair, and a direction in which the hair extends is the direction approaching the first surface.

9. A sheet bundle discharging apparatus configured to discharge a sheet bundle including a spine, the sheet bundle discharging apparatus comprising:

a conveyance unit configured to convey the sheet bundle;

a guide unit configured to guide the sheet bundle conveyed by the conveyance unit so that the spine is located at a leading end;

a receiving unit configured to receive the spine of the sheet bundle guided by the guide unit; and a discharging unit configured to discharge the sheet bundle to an outside of the sheet bundle discharging apparatus, wherein the receiving unit is rotatable between a first position and a second position, wherein the receiving unit receives the spine at the first position, wherein the receiving unit rotates from the first position to the second position to place the sheet bundle on the discharging unit, wherein the receiving unit includes:

a first surface against which the spine abuts when the receiving unit receives the spine at the first position;

a second surface on which the sheet bundle is slidable before the spine abuts against the first surface, the second surface being configured to push the sheet bundle in a rotation direction of the receiving unit while the receiving unit rotates from the first position to the second position; and a third surface which is arranged so as to be opposed to the second surface, the thirst surface being configured to regulate a movement of the sheet bundle in the rotation direction of the receiving unit while the receiving unit rotates from the first position to the second position, and wherein a friction coefficient between the sheet bundle and the third surface in a direction away from the first surface on the third surface is larger than a friction coefficient between the second surface and the sheet bundle.

* * * * *